US006866358B2

(12) United States Patent
Masuyama et al.

(10) Patent No.: US 6,866,358 B2
(45) Date of Patent: Mar. 15, 2005

(54) INK JET PRINTING METHOD AND APPARATUS

(75) Inventors: Atsuhiko Masuyama, Kanagawa (JP); Hiroshi Tajika, Kanagawa (JP); Yuji Konno, Kanagawa (JP); Norihiro Kawatoko, Kanagawa (JP); Takayuki Ogasahara, New York, NY (US); Tetsuya Edamura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 10/214,109

(22) Filed: Aug. 8, 2002

(65) Prior Publication Data

US 2003/0035021 A1 Feb. 20, 2003

(30) Foreign Application Priority Data

Aug. 10, 2001 (JP) ..... 2001/245030
Aug. 1, 2002 (JP) ..... 2002/225314

(51) Int. Cl.[7] ..... B41J 29/38; B41J 29/393
(52) U.S. Cl. ..... 347/14; 347/16; 347/19
(58) Field of Search ..... 347/14, 16, 19, 347/23, 40, 42

(56) References Cited

U.S. PATENT DOCUMENTS

2002/0054305 A1 5/2002 Ogasahara et al. ..... 358/1.8
2002/0070991 A1 6/2002 Otsuki ..... 347/16
2002/0130910 A1 9/2002 Otsuki ..... 347/5

FOREIGN PATENT DOCUMENTS

| | | | |
|---|---|---|---|
| DE | 199 47 419 | 4/2001 | ..... B41J/2/07 |
| EP | 0 992 347 | 4/2000 | ..... B41J/2/04 |
| EP | 0 995 603 | 4/2000 | ..... B41J/2/185 |
| EP | 0995603 A2 * | 4/2000 | ..... B41J/2/185 |
| EP | 1 059 168 | 12/2000 | ..... B41J/2/01 |
| EP | 1 186 425 | 3/2002 | ..... B41J/2/21 |
| JP | 2002-103586 | 4/2002 | |

* cited by examiner

*Primary Examiner*—Stephen D. Meier
*Assistant Examiner*—Alfred Duidding
(74) *Attorney, Agent, or Firm*—Fitzpatrick, Cella, Harper & Scinto

(57) ABSTRACT

A contamination of a printing medium caused by ink mist or the like is suppressed, which may scatter or float in an apparatus when margin-less printing is carried out in an ink jet printer. When margin-less printing for an edge of a printing medium P is performed, a predetermined edge area ① is printed using a smaller number of ejection openings during one scanning operation than that used for other areas ② and ③, while taking transportation errors relating to this end into consideration. This reduces the amount of ink mist resulting from ink ejected out of the edge of the printing medium during one scanning operation.

26 Claims, 20 Drawing Sheets

ONE-PASS PRINTING
... TWICE (TIME)

TWO-PASS PRINTING
... FOUR TIMES (TIME)

FOUR-PASS PRINTING
... EIGHT TIMES (TIME)

EIGHT-PASS PRINTING
... SIXTEEN TIMES (TIME)

FIRST SCANNING

SECOND SCANNING

INK JET PRINTING METHOD AND APPARATUS

This application is based on Japanese Patent Application Nos. 2001-245030 filed Aug. 10, 2001 and 2002-225314 filed Aug. 1, 2002, the contents of which are incorporated hereinto by reference.

BACKGROUND OF THE INVENTION

1. Field of the Invention

The present invention relates to an ink jet printing method and apparatus, and more specifically, to so called margin-less printing (hereinafter also referred as no edge blank printing), in which a printing medium such as a printing sheet is printed without forming any edge blank spaces on the printing medium.

2. Description of the Related Art

In an ink jet printing apparatus such as an ink jet printer, a platen is provided at an opposite portion to a printing head. The platen determines a positional relationship between a printing medium transported thereon and the printing head that ejects ink to the printing medium. For example, the platen has a plurality of platen ribs arranged on a top surface thereof in a scanning direction of the printing head. Supported on the tops of the platen ribs, the printing medium can be transported while maintaining a fixed distance from the printing head.

On the other hand, the ink jet printer can accomplish high-image-quality printing comparable to a silver salt photography. There correspondingly has been a growing demand for margin-less printing in which printing is carried out on the printing medium that is glossy like silver salt photographs In recent years, ink jet printers having the corresponding functions for the margin-less printing have been provided.

When the ink jet printer is used for the margin-less printing, it is necessary that ink is essentially ejected also to an area extending out from an edge of the printing medium to prevent a blank space from occurring on an edge portion of the printing medium. That is, errors may occur while the printing medium is being transported or errors in the size of the printing medium may occur in connection with cutting accuracy. Accordingly, to allow for such errors, ink is generally ejected to an area extending out from the position of the edge of the transported printing medium (see FIG. 11).

The ink ejected to the extending area is desirably corrected. For this purpose, for example, as shown in FIG. 11, a gap N3004 is formed in the above described platen rib M3003 so as to have a predetermined distance along a scanning range of the printing head, in a direction in which the printing medium is transported. An ink-absorbing member (not shown) is also provided at the bottom of the gap M3003. Further, an ink-absorbing member is provided on the platen at predetermined locations in a width direction of the printing medium corresponding to the scanning direction of the printing head, and over an area corresponding to a range within which ejection openings of the printing head are arranged. These arrangements for correcting ink enable ink ejected out from four edges of the printing medium to be corrected, thereby achieving margin-less printing to the printing medium.

However, when such no edge blank printing is executed notably at an edge area (including an area extending out from the edge of the printing medium in the direction in which it is transported and an area located inside this edge) located close to the edge of the printing medium, a large amount of ink mist may be generated, resulting in worse printing condition. The inventors have thus found that certain measures must be taken to reduce the amount of possible ink mist.

That is, when a normal area different from the edge area is printed, a distance between the printing medium, a target of ejected ink, and the printing head is relatively short, and then a distance over which the ejected ink flies is also short. Accordingly, a relatively small amount of ink mist may scatter or float without reaching the printing medium. However, when the edge area is printed, a distance between the ink-absorbing member, the target of ejected ink which is ejected out from the edge of the printing medium, and the printing head is relatively long, and then a distance over which the ejected ink flies is also long. Accordingly, a relatively large amount of ink mist may scatter or float without reaching the absorbing member. Thus, when the edge area is printed, certain measures must be taken to reduce the amount of mist. If no measures are taken for the mist, ink mist adhering to the printing medium or the platen ribs is likely to contaminate the printing medium. Further, ink mist adhering to rollers or gears is likely to disturb the normal operation of the rollers or gears.

SUMMARY OF THE INVENTION

The present invention is provided on the basis of attentions to the new technical problem, the need to reduce the amount of ink mist associated with the above described margin-less printing. It is an object of the present invention to provide an ink jet printing method and apparatus that can suppress the contamination of a printing medium or the like caused by ink or ink mist which may scatter or float inside the apparatus when margin-less printing is carried out.

It is another object of the present invention to provide a novel special printing method for the above-described margin-less printing.

In the first aspect of the present invention, there is provided an ink jet printing method of performing printing by repeating an operation of scanning a printing head having a plurality of ink ejection openings to a printing medium and an operation of transporting the printing medium, so as to eject ink from the printing head to the printing medium, wherein when printing is performed for both areas of a first area of the printing medium which extends out from an edge thereof in a direction in which the printing medium is transported and a second area on the printing medium which is located inside the edge, the number of ejection openings used for one scanning operation is reduced compared to printing only for the second area.

In the second aspect of the present invention, there is provided an ink jet printing method of performing printing by repeating an operation of scanning a printing head having a plurality of ink ejection openings to a printing medium and an operation of transporting the printing medium, so as to eject ink from the printing head to the printing medium, wherein when printing is performed for an edge area including an area located out of an edge of the printing medium in a direction in which the printing medium is transported and an area located inside the edge, the number of ejection openings used for one scanning operation is reduced compared to printing in an area on the printing medium which is other than the edge area.

In the third aspect of the present invention, there is provided an ink jet printing method of performing printing by repeating an operation of scanning a printing head having a plurality of ink ejection openings through to a printing medium and an operation of transporting the printing medium, so as to eject ink from the printing head to the printing medium, wherein when printing is performed for an edge area including an area located out of an edge of the printing medium in a direction in which the printing medium is transported and an area on the printing medium which is located inside the edge, an amount of ink ejected during one scanning operation is reduced compared to printing in an area on the printing medium which is other than the edge area.

In the fourth aspect of the present invention, there is provided an ink jet printing method of performing printing by repeating an operation of scanning a printing head having a plurality of ink ejection openings to a printing medium and an operation of transporting the printing medium, so as to cause the printing head to execute a plurality of times of scanning operation in the same area of the printing medium, wherein a mask used to generate ejection data for each of the plurality of scanning operations, a total duty of the mask for the plurality of scanning operations being less than 100%, is used to generate ejection data for each scanning operation in an edge area including an edge of the printing medium in a direction in which the printing medium is transported and having a predetermined width, so that an amount of ink ejected to the edge area is reduced compared to an area on the printing medium which is other than the edge area.

In the fifth aspect of the present invention, there is provided an ink jet printing method of performing printing by repeating an operation of scanning a printing head having a plurality of ink ejection openings to a printing medium and an operation of transporting the printing medium, so as to eject ink from the printing head to the printing medium, wherein when printing is performed in an edge area including an area located out of the printing medium in a direction in which the printing medium is transported and an area on the printing medium which is located inside the edge, the number of times of scanning operation by the printing head over a predetermined width along the transportation direction is reduced compared to printing in an area on the printing medium which is other than the edge area.

In the sixth aspect of the present invention, there is provided an ink jet printing method of performing printing by repeating an operation of scanning a printing head having a plurality of ink ejection openings to a printing medium and an operation of transporting the printing medium, so as to cause the printing head to execute a plurality of times of scanning operation in the same area of the printing medium, wherein when printing is performed in an edge area including an area located out of the printing medium in a direction in which the printing medium is transported and an area on the printing medium which is located inside the edge, a mask used for generating ejection data for each of the plurality of times of scanning operation for the edge area is different from the mask used in a case of printing for an area on the printing medium which is other than the edge area.

In the seventh aspect of the present invention, there is provided an ink jet printing apparatus for performing printing by repeating an operation of scanning a printing head having a plurality of ink ejection openings to a printing medium and an operation of transporting the printing medium, so as to eject ink from the printing head to the printing medium, wherein when printing is performed for both areas of a first area of the printing medium which extends out from an edge thereof in a direction in which the printing medium is transported and a second area on the printing medium which is located inside the edge, the number of ejection openings used for one scanning operation is reduced compared to printing only for the second area.

In the eighth aspect of the present invention, there is provided an ink jet printing apparatus for performing printing by repeating an operation of scanning a printing head having a plurality of ink ejection openings to a printing medium and an operation of transporting the printing medium, so as to eject ink from the printing head to the printing medium, wherein when printing is performed for an edge area including an area located out of an edge of the printing medium in a direction in which the printing medium is transported and an area located inside the edge, the number of ejection openings used for one scanning operation is reduced compared to printing in an area on the printing medium which is other than the edge area.

In the ninth aspect of the present invention, there is provided an ink jet printing apparatus for performing printing by repeating an operation of scanning a printing head having a plurality of ink ejection openings to a printing medium and an operation of transporting the printing medium, so as to eject ink from the printing head to the printing medium, wherein when printing is performed for an edge area including an area located out of an edge of the printing medium in a direction in which the printing medium is transported and an area on the printing medium which is located inside the edge, an amount of ink ejected during one scanning operation is reduced compared to printing in an area on the printing medium which is other than the edge area.

In the tenth aspect of the present inventions there is provided an ink jet printing apparatus for performing printing by repeating an operation of scanning a printing head having a plurality of ink ejection openings to a printing medium and an operation of transporting the printing medium, so as to cause the printing head to execute a plurality of times of scanning operation in the same area of the printing medium, wherein a mask used to generate ejection data for each of the plurality of scanning operations, a total duty of the mask for the plurality of scanning operations being less than 100%, is used to generate ejection data for each scanning operation in an edge area including an edge of the printing medium in a direction in which the printing medium is transported and having a predetermined width, so that an amount of ink ejected to the edge area is reduced compared to an area on the printing medium which is other than the edge area.

In the eleventh aspect of the present invention, there is provided an ink jet printing apparatus for performing printing by repeating an operation of scanning a printing head having a plurality of ink ejection openings to a printing medium and an operation of transporting the printing medium, so as to eject ink from the printing head to the printing medium, wherein when printing is performed in an edge area including an area located out of the printing medium in a direction in which the printing medium is transported and an area on the printing medium which is located inside the edge, the number of times of scanning operation by the printing head over a predetermined width along the transportation direction is reduced compared to printing in an area on the printing medium which is other than the edge area.

In the twelfth aspect of the present invention, there is provided an ink jet printing apparatus for performing printing by repeating an operation of scanning a printing head having a plurality of ink ejection openings to a printing medium and an operation of transporting the printing medium, so as to cause the printing head to execute a plurality of times of scanning operation in the same area of the printing medium, wherein when printing is performed in an edge area including an area located out of the printing medium in a direction in which the printing medium is transported and an area on the printing medium which is located inside the edge, a mask used for generating ejection data for each of the plurality of times of scanning operation for the edge area is different from the mask used in a case of printing for an area on the printing medium which is other than the edge area.

With the above configuration, when printing is carried out so as to leave no blank at a narrow portion adjoining an edge of a printing medium in a direction in which it is transported (what is called margin-less printing), in the case of printing is carried out both in a first area of the printing medium which extends out from the edge thereof in the transportation direction and a second area on the printing medium which is located inside the edge, the number of ejection openings used for one scanning operation is reduced compared to printing only in the second area. This reduces the amount of ink ejected to the first area, which extends out from the edge, thereby reducing the amount of scattering ink or floating ink mist.

Further, in another aspect of the present invention, for margin-less printing, when an edge area of a predetermined width including the edge of the printing medium in its transportation direction is printed, the amount of ink is reduced compared to printing in an area on the printing medium which is other than the edge area. This reduces the amount of ink ejected out from the printing medium for the edge area, and then the amount of scattering ink or floating ink mist can be reduced.

Furthermore, in another aspect of the present invention, the number of scanning operations performed by the printing head over a predetermined width in the transportation direction is reduced compared to an area other than the edge area. This reduces the time for which mist generated while the printing medium remains in the edge area adheres to the printing medium. In yet another aspect of the present invention, a mask used to generate ejection data for each of the plurality of scanning operations for printing the edge area is differentiated from a mask for an area other than the edge area so that a minimum mask unit of the mask for the edge area is greater than that of the mask for the area other than the edge area. Consequently, ink ejected out from the printing medium for the edge area becomes a fixed mass. This reduces the amount of scattering ink or floating mist.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Embodiments of the present invention will be described by referring to the accompanying drawings.

At first, an ink jet printer as an embodiment of a ink jet printing apparatus according to the present invention, by referring to FIGS. 1–10.

In this specification, a word "print" refers to not only forming significant information, such as characters and figures, but also forming images, designs or patterns on printing medium and processing media, whether the information is significant or insignificant or whether it is visible so as to be perceived by humans.

The word "printing medium" include not only a paper used in common printing apparatus, but a cloth, plastic films, metal plates, glass, ceramics, wood, leather or any other material that can receive ink.

Further, the word "ink" should be interpreted in its wide sense as with the word "print" and refers to liquid that is applied to the printing medium to form images, designs or patterns, process the printing medium or process ink (for example, coagulate or make insoluble a colorant in the ink applied to the printing medium).

[Apparatus Body]

Figure 1:
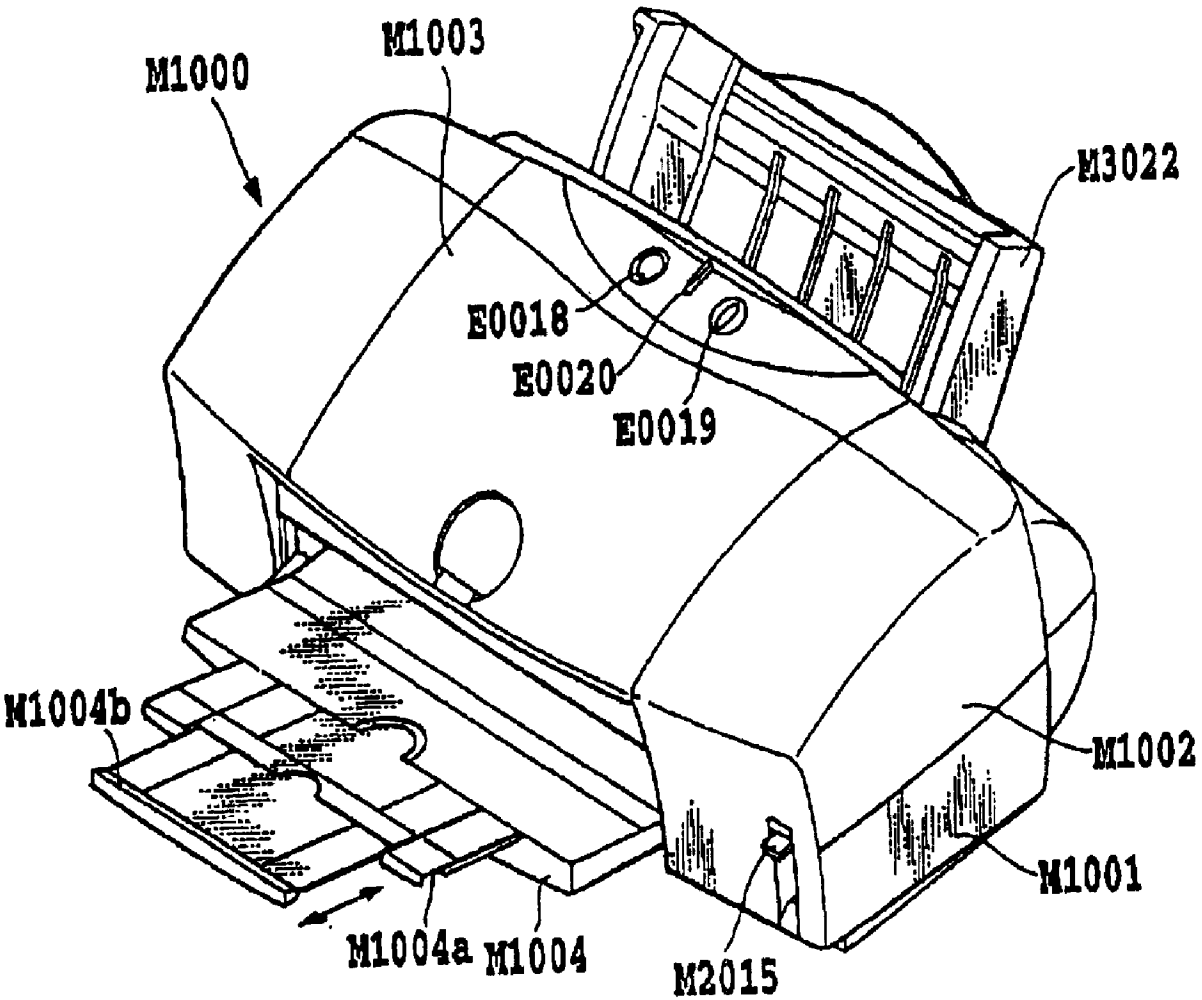
FIG. 1 is a perspective view showing an external construction of an ink jet printer as one embodiment of the present invention.
Figure 2:
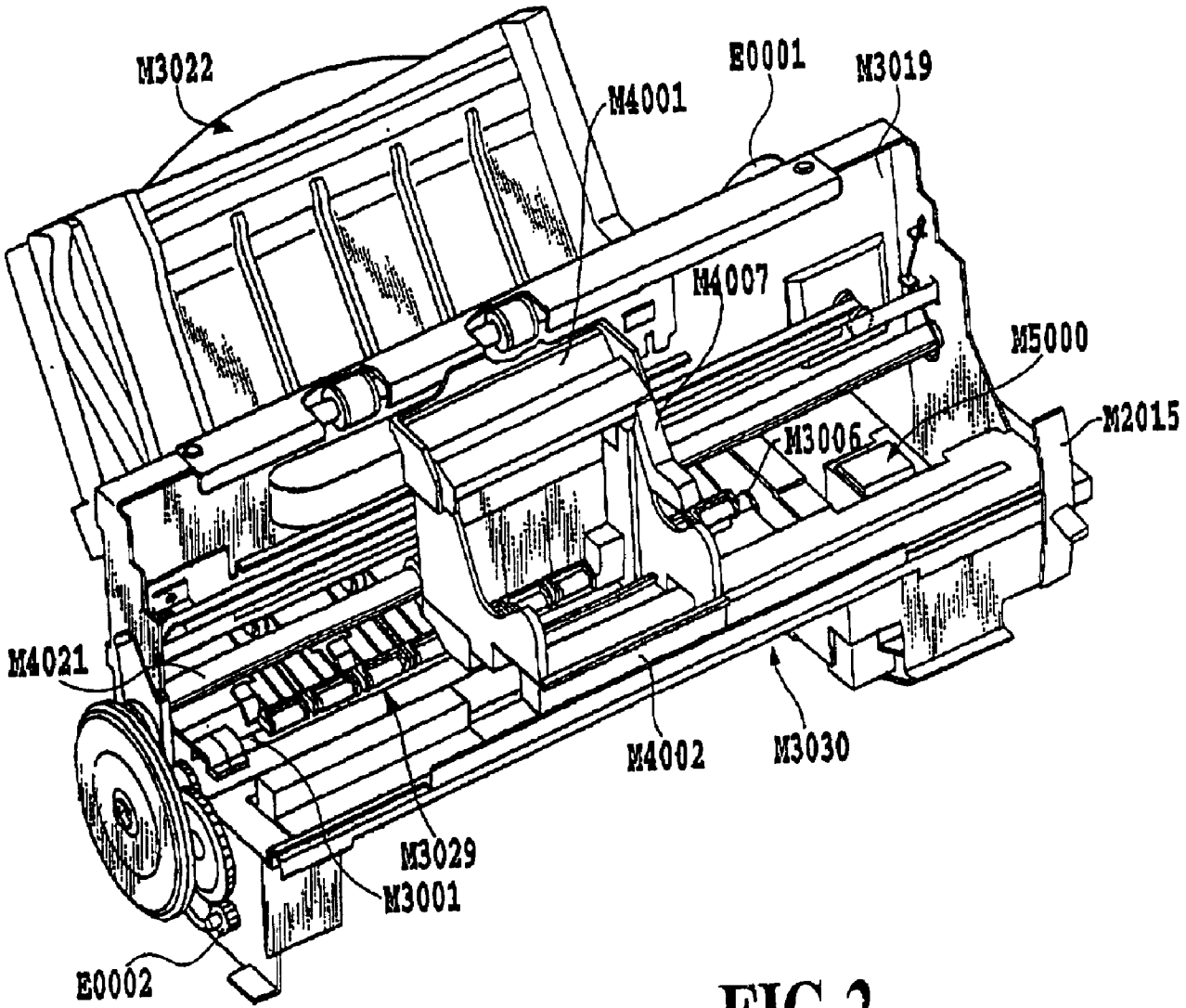
FIG. 2 is a perspective view showing the printer of FIG. 1 with an enclosure member removed.

FIGS. 1 and 2 show an outline construction of a printer using an ink jet printing system. In FIG. 1, a housing of a printer body M1000 of this embodiment has an enclosure member, including a lower case M1001, an upper case M1002, an access cover M1003 and a discharge tray M1004, and a chassis M3019 (see FIG. 2) accommodated in the enclosure member.

The chassis M3019 is made of a plurality of plate-like metal members with a predetermined rigidity to form a skeleton of the printing apparatus and holds various printing operation mechanisms described later.

The lower case M1001 forms roughly a lower half of the housing of the printer body M1000 and the upper case M1002 forms roughly an upper half of the printer body M1000. These upper and lower cases, when combined, form a hollow structure having an accommodation space therein to accommodate various mechanisms described later. The printer body M1000 has an opening in its top portion and front portion.

The discharge tray M1004 has one end portion thereof rotatable supported on the lower case M1001. The discharge tray M1004, when rotated, opens or closes an opening formed in the front portion of the lower case M1001. When the print operation is to be performed, the discharge tray M1004 is rotated forwardly to open the opening so that printed sheets can be discharged and successively stacked. The discharge tray M1004 accommodates two auxiliary trays M1004*a*, M1004*b*. These auxiliary trays can be drawn out forwardly as required to expand or reduce the paper support area in three steps.

The access cover M1003 has one end portion thereof rotatably supported on the upper case M1002 and opens or closes an opening formed in the upper surface of the upper case M1002. By opening the access cover M1003, a print head cartridge H1000 or an ink tank H1900 installed in the body can be replaced. When the access cover M1003 is opened or closed, a projection formed at the back of the access cover, not shown here, pivots a cover open/close lever. Detecting the pivotal position of the lever as by a micro-switch and so on can determine whether the access cover is open or closed.

At the upper rear surface of the upper case M1002 a power key E0018, a resume key E0019 and an LED E0020 are provided. When the power key E0018 is pressed, the LED E0020 lights up indicating to an operator that the apparatus is ready to print. The LED E0020 has a variety of display functions, such as alerting the operator to printer troubles as by changing its blinking intervals and color. Further, a buzzer E0021 (FIG. 7) may be sounded. When the trouble is eliminated, the resume key E0019 is pressed to resume the printing.

[Printing Operation Mechanism]

Next, a printing operation mechanism installed and held in the printer body M1000 according to this embodiment will be explained.

The printing operation mechanism in this embodiment comprises: an automatic sheet feed unit M3022 to automatically feed a print sheet into the printer body; a sheet transport unit M3029 to guide the print sheets, fed one at a time from the automatic sheet feed unit, to a predetermined print position and to guide the print sheet from the print position to a discharge unit M3030; a print unit to perform a desired printing on the print sheet carried to the print position; and an ejection performance recovery unit M5000 to recover the ink ejection performance of the print unit.

(Printing Unit)

Here, the print unit will be described. The print unit comprises a carriage M4001 movably supported on a carriage shaft M4021 and a print head cartridge H10000 removably mounted on the carriage M4001.

[Print Head Cartridge]

First, the print head cartridge used in the print unit will be described with reference to FIGS. 3 to 5.

Figure 3:
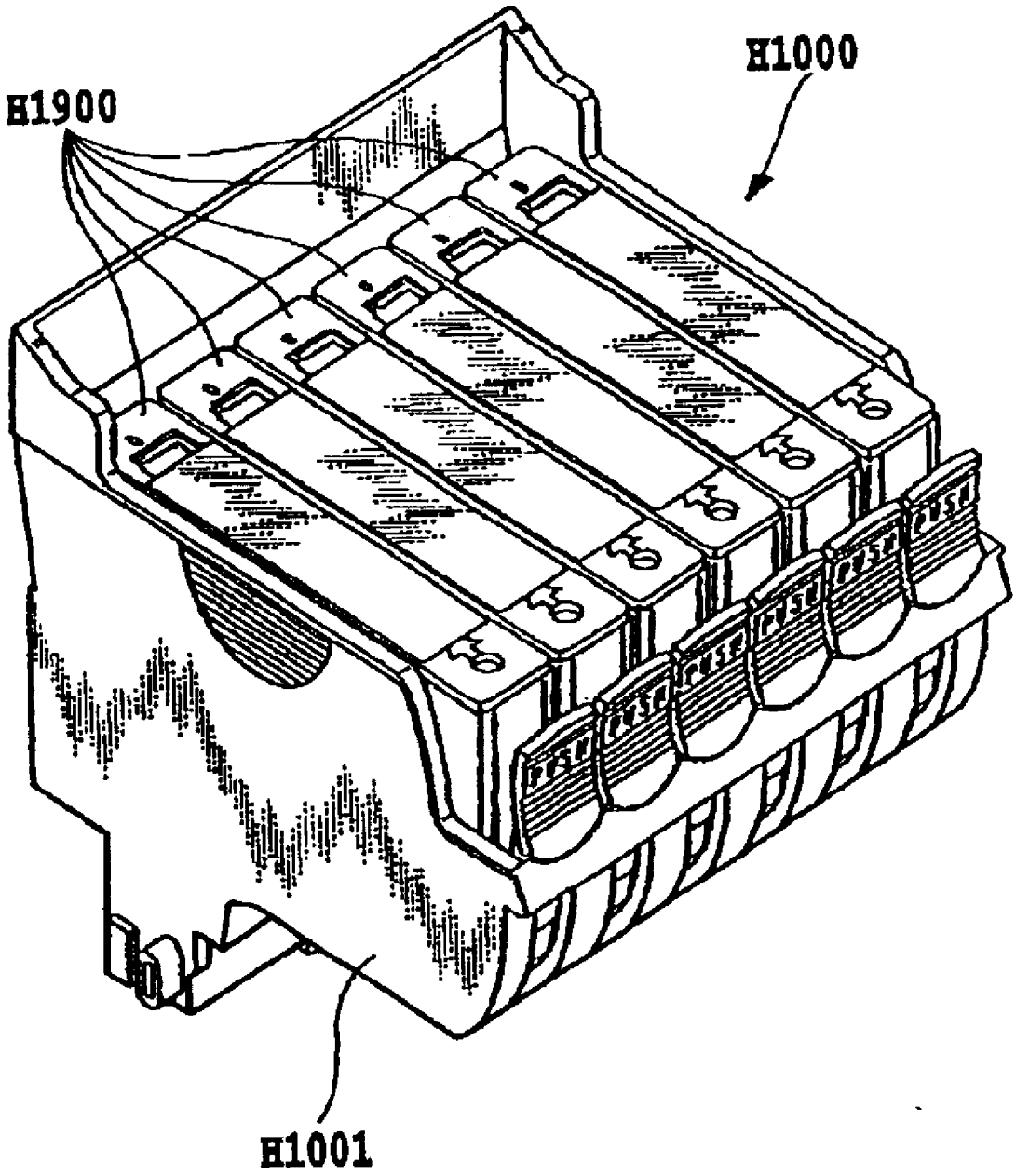
FIG. 3 is a perspective view showing an assembled print head cartridge used in the printer of one embodiment of the present invention.
Figure 4:
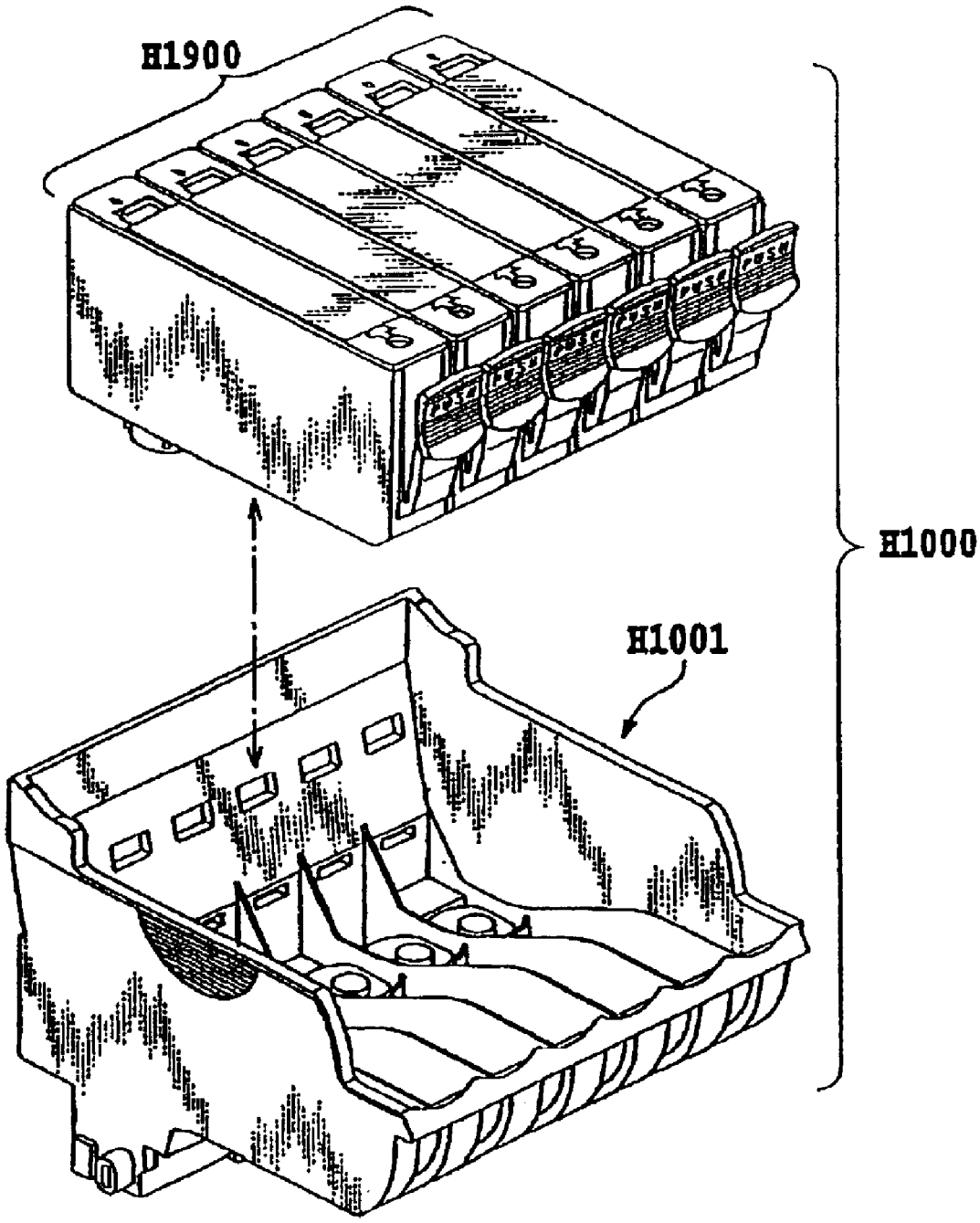
FIG. 4 is an exploded perspective view showing the print head cartridge of FIG. 3.

The print head cartridge H1000 in this embodiment, as shown in FIG. 3, has an ink tank H1900 containing inks and a print head H1001 for ejecting ink supplied from the ink tank H1900 out through nozzles according to print information. The print head H1001 is of a so-called cartridge type in which it is removably mounted to the carriage M4001 described later.

The ink tank for this print head cartridge H1000 consists of separate ink tanks H1900 of, for example, black, light cyan, light magenta, cyan, magenta and yellow to enable color printing with as high an image quality as photograph. As shown in FIG. 4, these individual ink tanks are removably mounted to the print head H1001.

Figure 5:
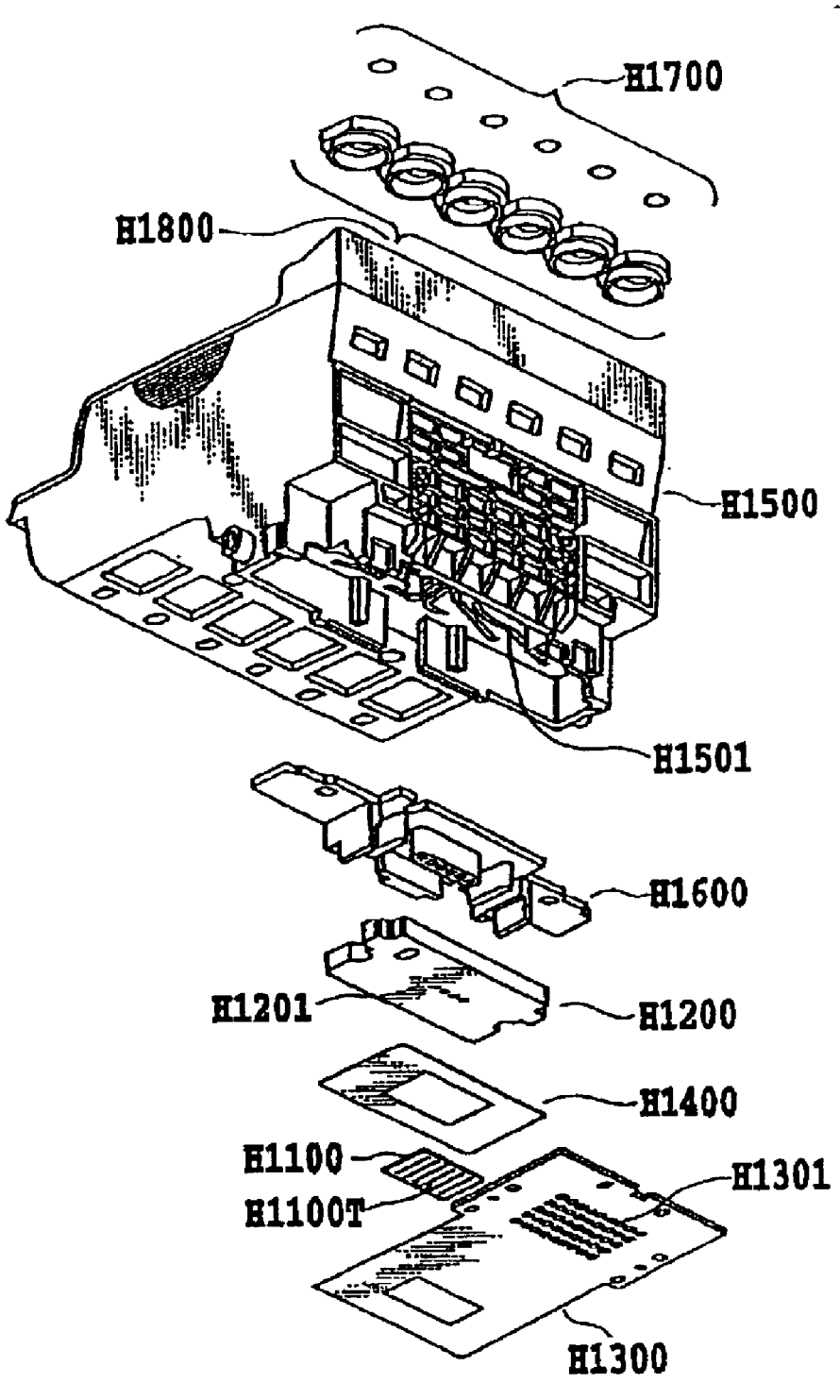
FIG. 5 is an exploded perspective view of the print head of FIG. 4 as seen diagonally below.

Then, the print head H1001, as shown in the perspective view of FIG. 5, comprises a print element substrate H1100, a first plate H1200, an electric wiring board H1300, a second plate H1400, a tank holder H1500, a flow passage forming member H1600, a filter H1700 and a seal rubber H1800.

The print element substrate H1100 has formed in one of its surfaces, by the film deposition technology, a plurality of print elements to produce energy for ejecting ink and electric wires, such as aluminum, for supplying electricity to individual print elements. A plurality of ink passages and a plurality of nozzles H1100T, both corresponding to the print elements, are also formed by the photolithography technology. In the back of the print element substrate H1100, there are formed ink supply ports for supplying ink to the plurality of ink passages. The print element substrate H1100 is securely bonded to the first plate H1200 which is formed with ink supply ports H1201 for supplying ink to the print element substrate H1100. The first plate H1200 is securely bonded with the second plate H1400 having an opening. The second plate H1400 holds the electric wiring board H1300 to electrically connect the electric wiring board H1300 with the print element substrate H1100. The electric wiring board H1300 is to apply electric signals for ejecting ink to the print element substrate H1100, and has electric wires associated with the print element substrate H1100 and external signal input terminals H1301 situated at electric wires' ends for receiving electric signals from the printer body. The external signal input terminals H1301 are positioned and fixed at the back of a tank holder H1500 described later.

The tank holder H1500 that removably holds the ink tank H1900 is securely attached, as by ultrasonic fusing, with the flow passage forming member H1600 to form an ink passage H1501 from the ink tank H1900 to the first plate H1200. At the ink tank side end of the ink passage H1501 that engages with the ink tank H1900, a filter H1700 is provided to prevent external dust from entering. A seal rubber H1800 is provided at a portion where the filter H1700 engages the ink tank H1900, to prevent evaporation of the ink from the engagement portion.

As described above, the tank holder unit, which includes the tank holder H1500 the flow passage forming member H1600, the filter H1700 and the seal rubber H1800, and the print element unit, which includes the print element substrate H1100, the first plate H1200, the electric wiring board H1300 and the second plate H1400, are combined as by adhesives to form the print head H1001.

[Carriage]

Next, by referring to FIG. 2, the carriage M4001 carrying the print head cartridge H1000 will be explained.

As shown in FIG. 2, the carriage M4001 has a carriage cover M4002 for guiding the print head H1001 to a predetermined mounting position on the carriage H4001, and a head set lever M4007 that engages and presses against the tank holder H1500 of the print head H1001 to set the print head H1001 at a predetermined mounting position.

That is, the head set lever M4007 is provided at the upper part of the carriage M4001 so as to be pivotable about a head set lever shaft. There is a spring-loaded head set plate (not shown) at an engagement portion where the carriage M4001 engages the print head H1001. With the spring force, the head set lever M4007 presses against the print head H1001 to mount it on the carriage M4001.

At another engagement portion of the carriage M4001 with the print head H1001, there is provided a contact flexible printed cable (see FIG. 7; simply referred to as a contact FPC hereinafter) E0011 whose contact portion electrically contacts a contact portion (external signal input terminals) H1301 provided in the print head H1001 to transfer various information for printing and supply electricity to the print head H1001.

Between the contract portion of the contact FPC E0011 and the carriage M4001 there is an elastic member not shown, such as rubber. The elastic force of the elastic member and the pressing force of the head set lever spring combine to ensure a reliable contact between the contact portion of the contact FPC E0011 and the carriage M4001. Further, the contact FPC E0011 is connected to a carriage substrate E0013 mounted at the back of the carriage M4001 (see FIG. 7).

[Scanner]

The printer of this embodiment can mount a scanner in the carriage M4001 in place of the print head cartridge H1000 and be used as a reading device.

The scanner moves together with the carriage M4001 in the main scan direction, and reads an image on a document fed instead of the printing medium as the scanner moves in the main scan direction. Alternating the scanner reading operation in the main scan direction and the document feed in the sub-scan direction enables one page of document image information to be read.

Figure 6B:
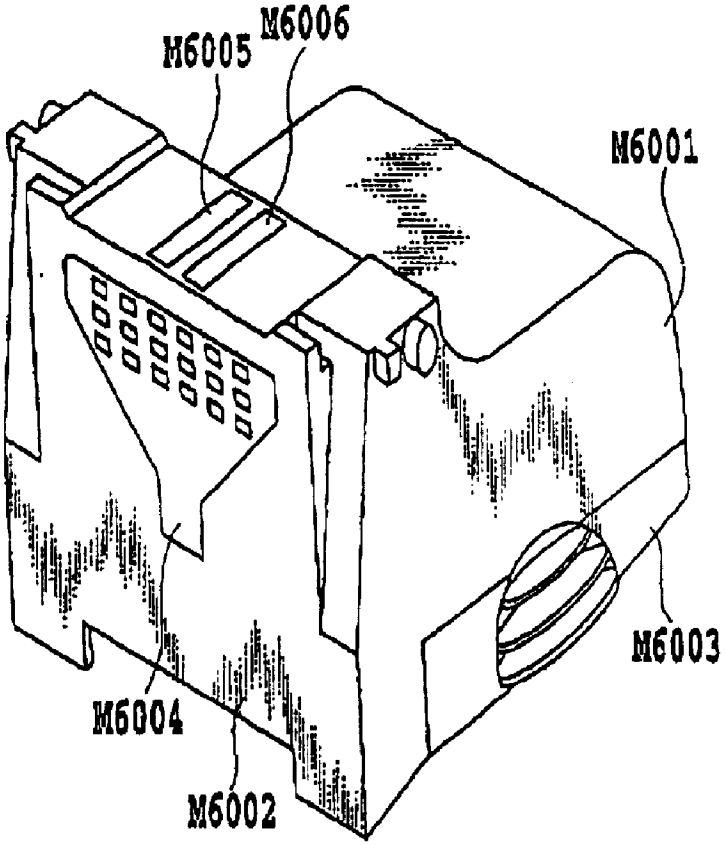
FIGS. 6A and 6B are perspective views showing a construction of a scanner cartridge upside down which can be mounted in the printer of one embodiment of the present invention instead of the print head cartridge of FIG. 3.
Figure 6A:
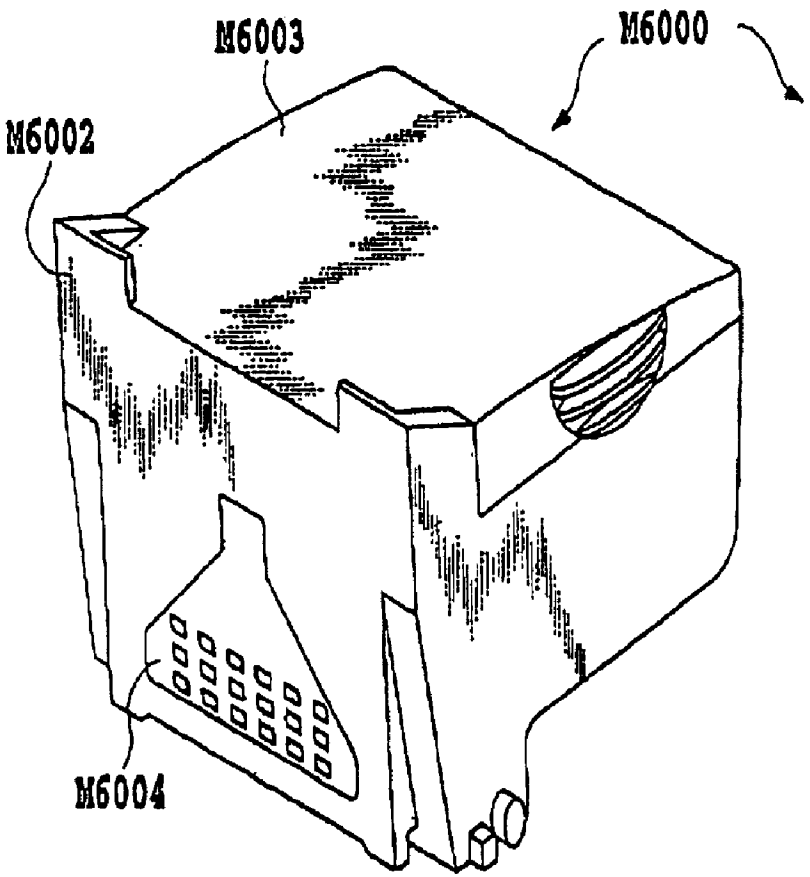

FIGS. 6A and 6B show the scanner M6000 upside down to explain about its outline construction.

As shown in the figures a scanner holder M6001 is shaped like a box and contains an optical system and a processing circuit necessary for reading. A reading lens M6006 is provided at a portion that faces the surface of a document when the scanner M6000 is mounted on the carriage M4001. The lens M6006 focuses light reflected from the document surface onto a reading unit inside the scanner to read the document image. An illumination lens M6005 has a light source not shown inside the scanner. The light emitted from the light source is radiated onto the document through the lens M6005.

The scanner cover M6003 secured to the bottom of the scanner holder M6001 shields the interior of the scanner holder M6001 from light. Louver-like grip portions are provided at the sides to improve the ease with which the scanner can be mounted to and dismounted from the carriage M4001. The external shape of the scanner holder M6001 is almost similar to that of the print head H1001, and the scanner can be mounted to or dismounted from the carriage M4001 in a manner similar to that of the print head H1001.

The scanner holder M6001 accommodates a substrate having a reading circuit, and a scanner contact PCB M6004 connected to this substrate is exposed outside. When the scanner M6000 is mounted on the carriage M4001, the scanner contact PCB M6004 contacts the contact FPC E0011 of the carriage M4001 to electrically connect the substrate to a control system on the printer body side through the carriage M4001.

[Configuration of Printer Electric Circuit]

Next, an electric circuit configuration in this embodiment of the invention will be explained.

Figure 7:
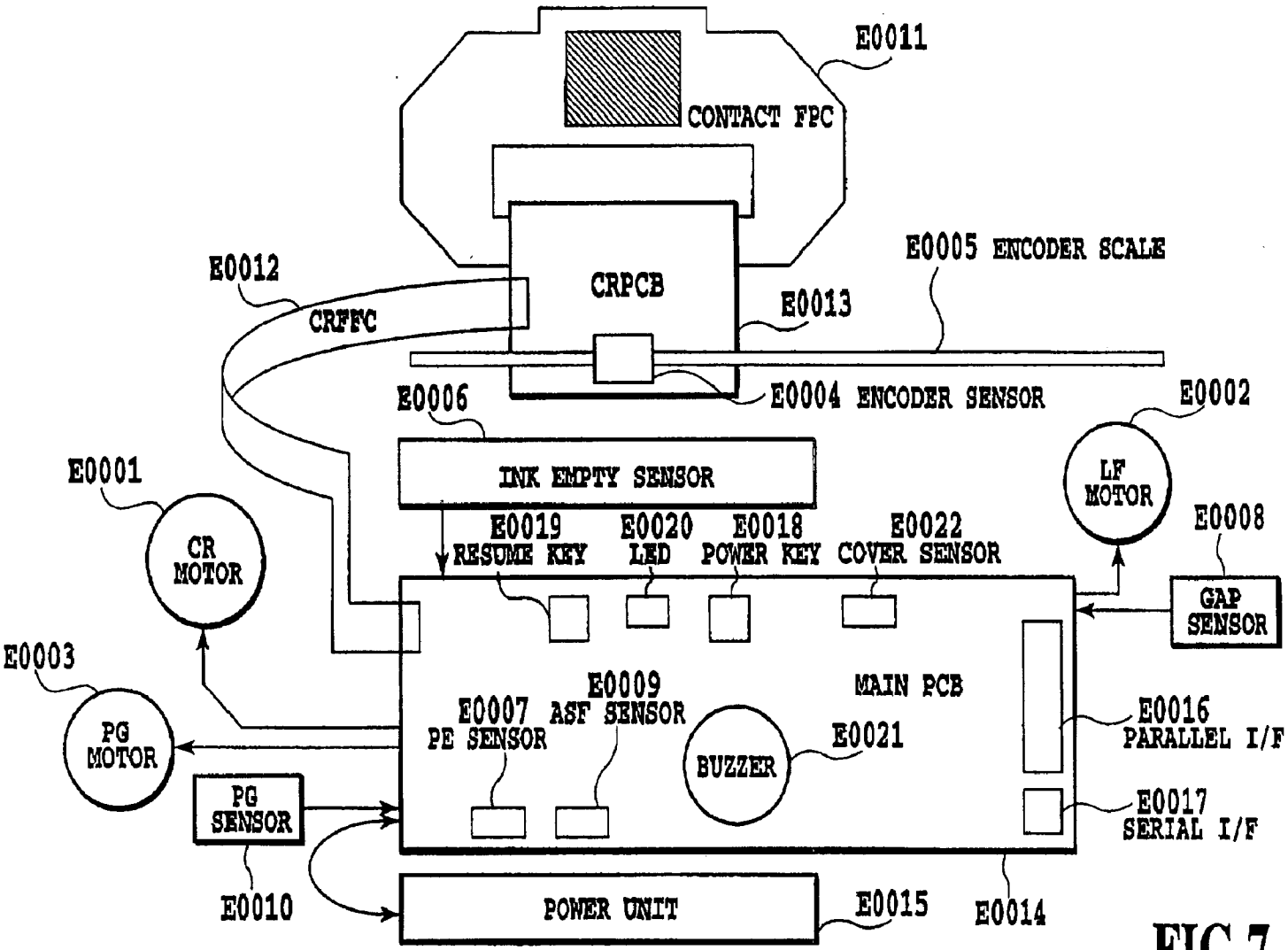
FIG. 7 is a block diagram schematically showing the overall configuration of an electric circuitry of the printer according to one embodiment of the present invention.

FIG. 7 schematically shows the overall configuration of the electric circuit in this embodiment.

The electric circuit in this embodiment comprises mainly a carriage substrate (CRPCB) E0013, a main PCB (printed circuit board) E0014 and a power supply unit E0015.

The power supply unit E0015 is connected to the main PCB E0014 to supply a variety of drive power.

The carriage substrate E0013 is a printed circuit board unit mounted on the carriage M4001 (FIG. 2) and functions as an interface for transferring signals to and from the print head through the contact FPC E0011. In addition, based on a pulse signal output from an encoder sensor E0004 as the carriage M4001 moves, the carriage substrate E0013 detects a change in the positional relation between an encoder scale E0005 and the encoder sensor E0004 and sends its output signal to the main PCB E0014 through a flexible flat cable (CRFFC) E0012.

Further, the main PCB E0014 is a printed circuit board unit that controls the operation of various parts of the ink jet printing apparatus in this embodiment, and has I/O ports for a paper end sensor (PE sensor) E0007, an automatic sheet feeder (ASF) sensor E0009, a cover sensor E0022, a parallel interface (parallel I/F) E0016, a serial interface (Serial I/F) E0017, a resume key E0019, an LED E0020, a power key E0018 and a buzzer E0021 The main PCB E0014 is connected to and controls a motor (CR motor) E0001 that constitutes a drive source for moving the carriage M4001 in the main scan direction; a motor (LF motor) E0002 that constitutes a drive source for transporting the printing medium; and a motor (PG motor) E0003 that performs the functions of recovering the ejection performance of the print head and feeding the printing medium. The main PCB E0014 also has connection interfaces with an ink empty sensor E0006, a gap sensor E0008, a PG sensor E0010, the CRFFC E0012 and the power supply unit E0015.

Figures 8, 8A:
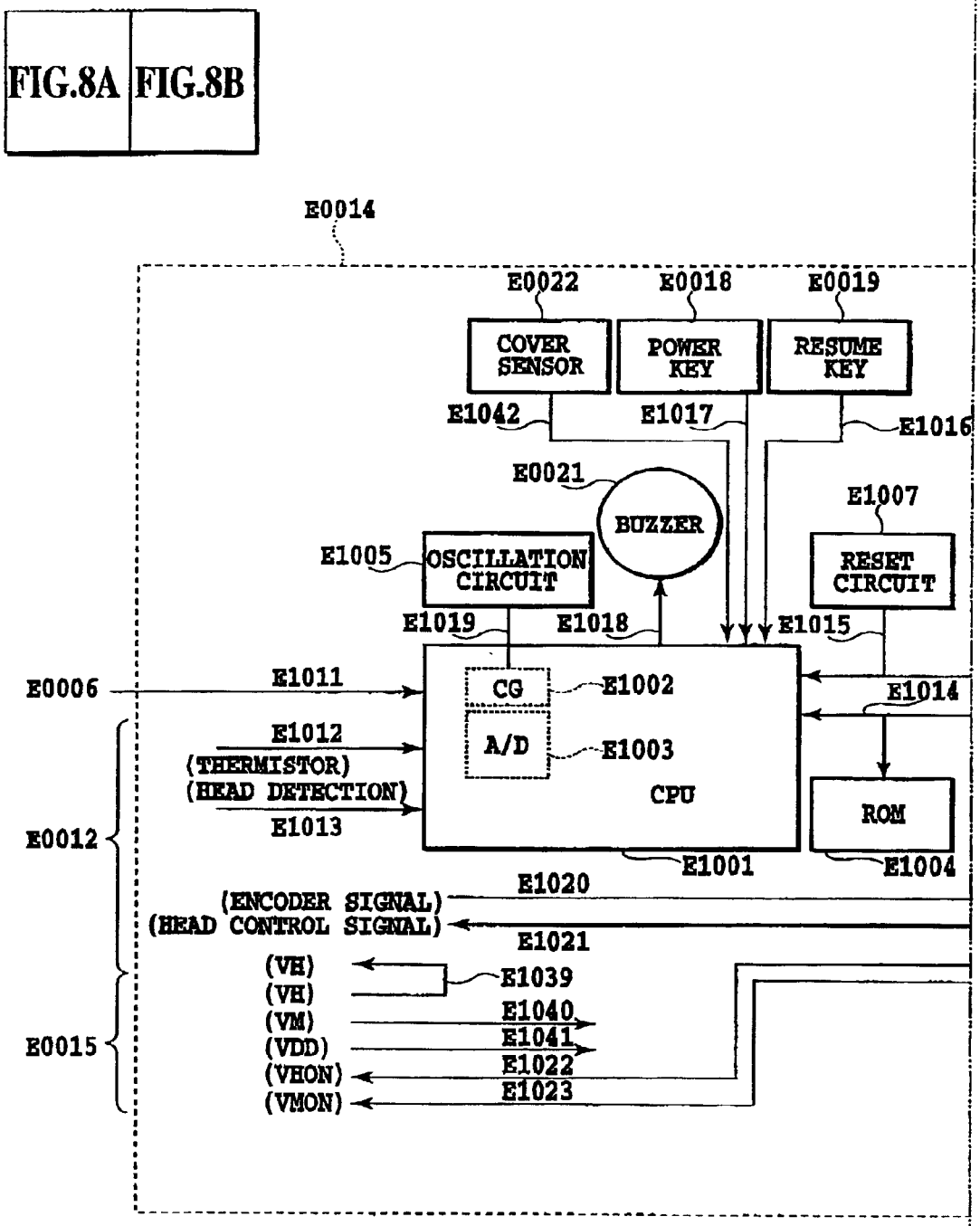
FIG. 8 is a diagram showing the relation between FIGS. 8A and 8B, FIGS. 8A and 8B being block diagrams representing an example inner configuration of a main printed circuit board (PCB) in the electric circuitry of FIG. 7.
Figure 8B:
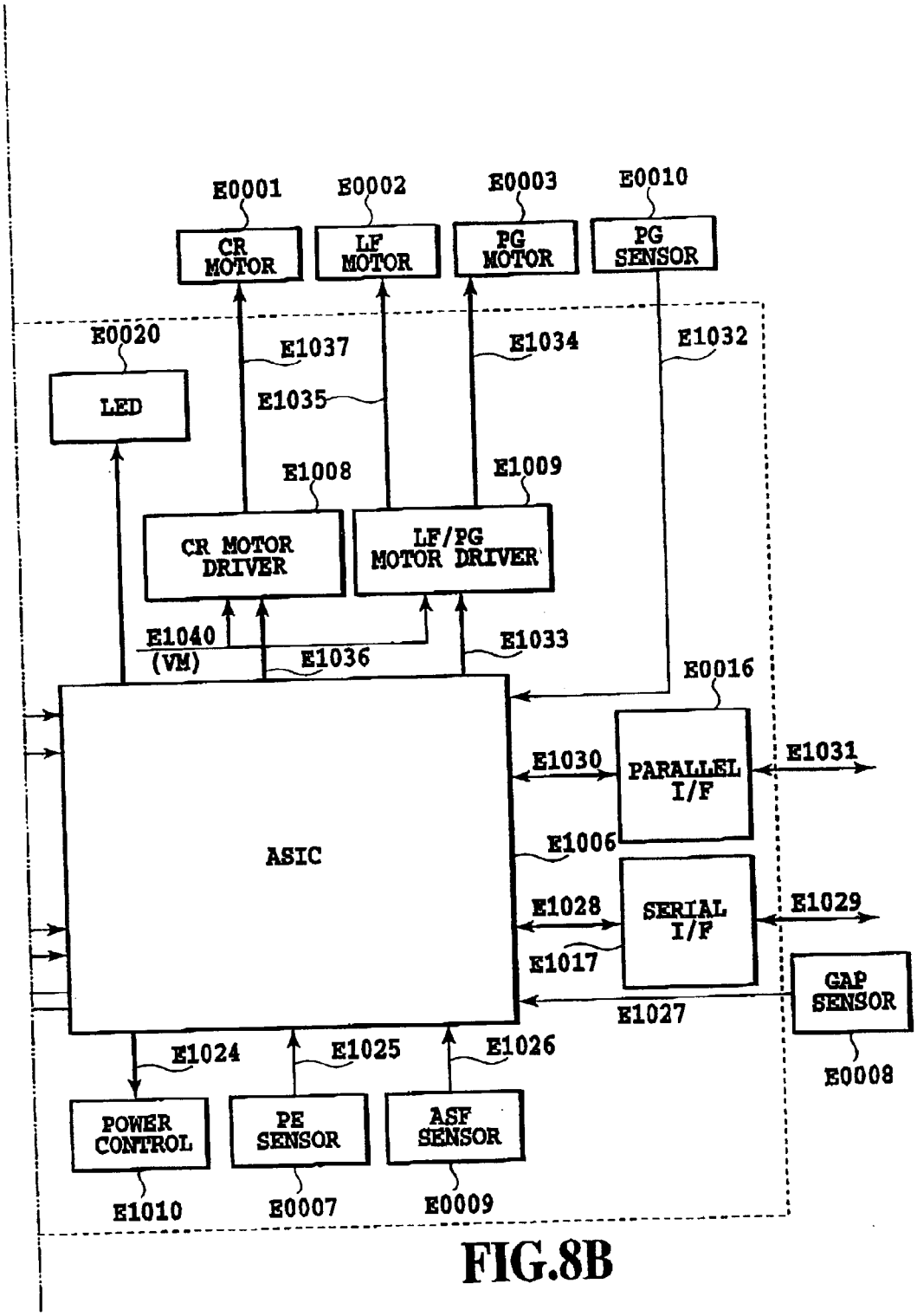

FIG. 8 is a diagram showing the relation between FIGS. 8A and 8B, and FIGS. 8A and 8B are block diagrams showing an inner configuration of the main PCB E0014. Reference number E1001 represents a CPU, which has a clock generator (CG) E1002 connected to an oscillation circuit E1005 to generate a system clock based on an output signal E1019 of the oscillation circuit E1005. The CPU E1001 is connected to an ASIC (application specific integrated circuit) and a ROM E1004 through a control bus E1014. According to a program stored in the ROM E1004, the CPU E1001 controls the ASIC E1006, checks the status of an input signal E1017 from the power key, an input signal E1016 from the resume key, a cover detection signal E1042 and a head detection signal (HSENS) E1013, drives the buzzer E0021 according to a buzzer signal (BUZ) E1018, and checks the status of an ink empty detection signal (INKS) E1011 connected to a built-in A/D converter E1003 and of a temperature detection signal (TH) E1012 from a thermistor. The CPU E1001 also performs various other logic operations and makes conditional decisions to control the operation of the ink jet printing apparatus.

The head detection signal E1013 is a head mount detection signal entered from the print head cartridge H1000 through the flexible flat cable E0012, the carriage substrate E0013 and the contact FPC E0011. The ink empty detection signal E1011 is an analog signal output from the ink empty sensor E0006. The temperature detection signal E1012 is an analog signal from the thermistor (not shown) provided on the carriage substrate E0013.

Designated E1008 is a CR motor driver that uses a motor power supply (VM) E1040 to generate a CR motor drive signal E1037 according to a CR motor control signal E1036 from the ASIC E1006 to drive the CR motor E0001. E1009 designates an LF/PG motor driver which uses the motor power supply E1040 to generate an LF motor drive signal E1035 according to a pulse motor control signal (PM control signal) E1033 from the ASIC E1006 to drive the LF motor. The LF/PG motor driver E1009 also generates a PG motor drive signal E1034 to drive the PG motor.

Designated E1010 is a power supply control circuit which controls the supply of electricity to respective sensors with light emitting elements according to a power supply control signal E1024 from the ASIC E1006. The parallel I/F E0016 transfers a parallel I/F signal E1030 from the ASIC E1006 to a parallel I/F cable E1031 connected to external circuits and also transfers a signal of the parallel I/F cable E1031 to the ASIC E1006. The serial I/F E0017 transfers a serial I/F signal E1028 from the ASIC E1006 to a serial I/F cable E1029 connected to external circuits, and also transfers a signal from the serial I/F cable E1029 to the ASIC E1006.

The power supply unit E0015 provides a head power signal (VH) E1039, a motor power signal (VM) E1040 and a logic power signal (VDD) E1041. A head power ON signal (VHON) E1022 and a motor power ON signal (VMON) E1023 are sent from the ASIC E1006 to the power supply unit E0015 to perform the ON/OFF control of the head power signal E1039 and the motor power signal E1040. The logic power signal (VDD) E1041 supplied from the power supply unit E0015 is voltage-converted as required and given to various parts inside or outside the main PCB E0014.

The head power signal E1039 is smoothed by a circuit of the main PCB E0014 and then sent out to the flexible flat cable E0011 to be used for driving the print head cartridge H1000.

E1007 denotes a reset circuit which detects a reduction in the logic power signal E1041 and sends a reset signal (RESET) to the CPU E1001 and the ASIC E1006 to initialize them.

The ASIC E1006 is a single-chip semiconductor integrated circuit and is controlled by the CPU E1001 through the control bus E1014 to output the CR motor control signal E1036, the PM control signal E1033, the power supply control signal E1024, the head power ON signal E1022 and the motor power ON signal E1023. It also transfers signals to and from the parallel interface E0016 and the serial interface E0017. In addition, the ASIC E1006 detects the status of a PE detection signal (PES) E1025 from the PE sensor E0007, an ASF detection signal (ASFS) E1026 from the ASF sensor E0009, a gap detection signal (GAPS) E1027 from the GAP sensor E0008 for detecting a gap between the print head and the printing medium, and a PG detection signal (PGS) E1032 from the PG sensor E0010, and sends data representing the statuses of these signals to the CPU E1001 through the control bus E1014. Based on the data received, the CPU E1001 controls the operation of an LED drive signal E1038 to turn on or off the LED E0020.

Further, the ASIC E1006 checks the status of an encoder signal (ENC) E1020, generates a timing signal, interfaces with the print head cartridge H1000 and controls the print operation by a head control signal E1021. The encoder signal (ENC) E1020 is an output signal of the CR encoder sensor E0004 received through the flexible flat cable E0012. The head control signal E1021 is sent to the print head H1001 through the flexible flat cable E0012, carriage substrate E0013 and contact FPC E0011.

Figures 9, 9A:
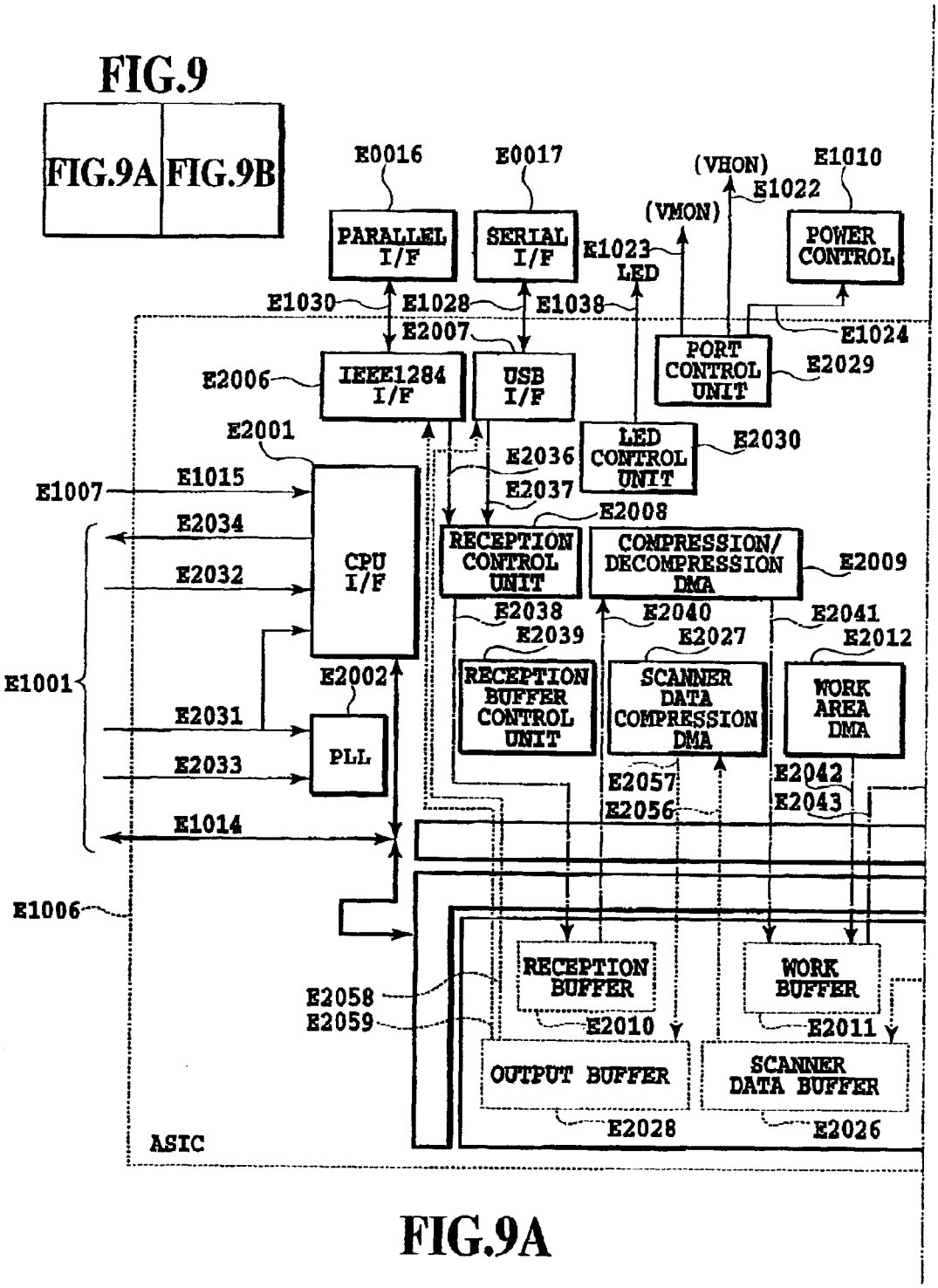
FIG. 9 is a diagram showing the relation between FIGS. 9A and 9B, FIGS. 9A and 9B being block diagrams representing an example inner configuration of an application specific integrated circuit (ASIC) in the main PCB of FIGS. 8A and 8B.
Figure 9B:
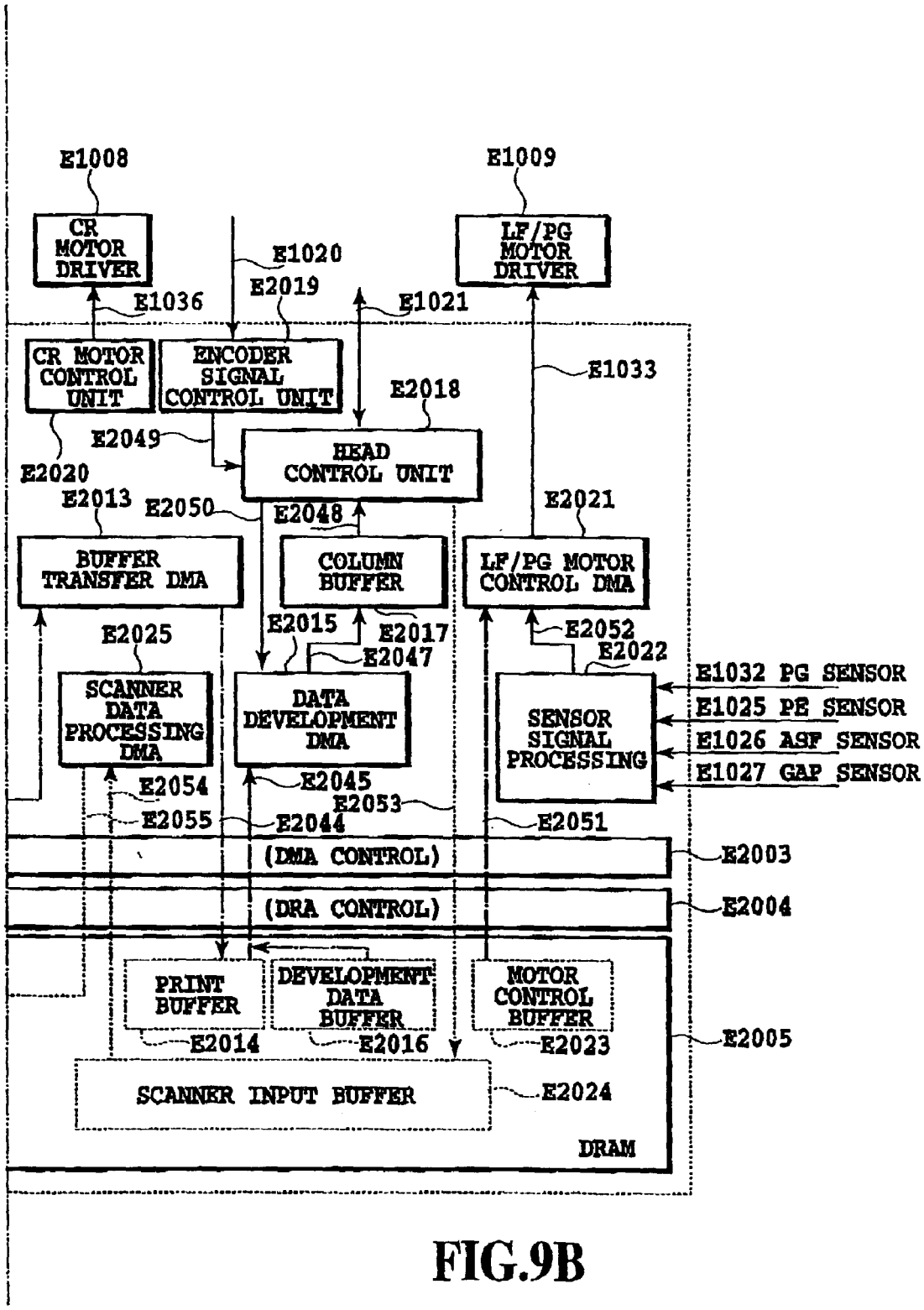

FIG. 9 is a diagram showing the relation between FIGS. 9A and 9B, and FIGS. 9A and 9B are block diagrams showing an example internal configuration of the ASIC E1006.

In these figures, only the flow of data, such as print data and motor control data, associated with the control of the head and various mechanical components is shown between each block, and control signals and clock associated with the read/write operation of the registers incorporated in each block and control signals associated with the DMA control are omitted to simplify the drawing.

In the figures, reference number E2002 represents a PLL controller which, based on a clock signal (CLK) E2031 and a PLL control signal (PLLON) E2033 output from the CPU E1001, generates a clock (not shown) to be supplied to the most part of the ASIC E1006.

Denoted E2001 is a CPU interface (CPU I/F) E2001, which controls the read/write operation of register in each block, supplies a clock to some blocks and accepts an interrupt signal (none of these operations are shown) according to a reset signal E1015, a software reset signal (PDWN) E2032 and a clock signal (CLK) E2031 output from the CPU E1001, and control signals from the control bus E1014. The CPU I/F E2001 then outputs an interrupt signal (INT) E2034 to the CPU E1001 to inform it of the occurrence of an interrupt within the ASIC E1006.

E2005 denotes a DRAM which has various areas for storing print data, such as a reception buffer E2010, a work buffer E2011, a print buffer E2014 and a development data buffer E2016. The DRAM E2005 also has a motor control buffer E2023 for motor control and, as buffers used instead of the above print data buffers during the scanner operation mode, a scanner input buffer E2024, a scanner data buffer E2026 and an output buffer E2028.

The DRAM E2005 is also used as a work area by the CPU E1001 for its own operation. Designated E2004 is a DRAM control unit E2004 which performs read/write operations on the DRAM E2005 by switching between the DRAM access from the CPU E1001 through the control bus and the DRAM access from a DMA control unit E2003 described later.

The DMA control unit E2003 accepts request signals (not shown) from various blocks and outputs address signals and control signals (not shown) and, in the case of write operation, write data E2038, E2041, E2044, E2053, E2055, E2057 etc. to the DRAM control unit to make DRAM accesses. In the case of read operation, the DMA control unit E2003 transfers the read data E2040, E2043, E2045, E2051, E2054, E2056, E2058, E2059 from the DRAM control unit E2004 to the requesting blocks.

Denoted E2006 is an IEEE 1284 I/F which functions as a bi-directional communication interface with external host devices, not shown, through the parallel I/F E0016 and is controlled by the CPU E1001 via CPU I/F E2001. During the printing operation, the IEEE 1284 I/F E2006 transfers the receive data (PIF receive data E2036) from the parallel I/F E0016 to a reception control unit E2008 by the DMA processing. During the scanner reading operation the 1284 I/F E2006 sends the data (1284 transmit data (RDPIF) E2059) stored in the output buffer E2028 in the DRAM E2O05 to the parallel I/F E0016 by the DMA processing.

Designated E2007 is a universal serial bus (USB) I/F which offers a bi-directional communication interface with external host devices, not shown, through the serial I/F E0017 and is controlled by the CPU E1001 through the CPU I/F E2001. During the printing operation, the universal serial bus (USB) I/F E2007 transfers received data (USB receive data E2037) from the serial I/F E0017 to the reception control unit E2008 by the DMA processing. During the scanner reading, the universal serial bus (USB) I/F E2007 sends data (USB transmit data (RDUSB) E2058) stored in the output buffer E2028 in the DRAM B2005 to the serial I/F E0017 by the DMA processing The reception control unit E2008 writes data (WDIF E2038) received from the 1284 I/F E2006 or universal serial bus (USB) I/F E2007, which ever is selected, into a reception buffer write address managed by a reception buffer control unit E2039.

Designated E2009 is a compression/decompression DMA controller which is controlled by the CPU E1001 through the CPU I/F E2001 to read received data (raster data) stored in a reception buffer E2010 from a reception buffer read address managed by the reception buffer control unit E2039, compress or decompress the data (RDWK) E2040 according to a specified mode, and write the data as a print code string (WDWK) E2041 into the work buffer area.

Designated E2013 is a print buffer transfer DMA controller which is controlled by the CPU E1001 through the CPU I/F E2001 to read print codes (RDWP) E2043 on the work buffer E2011 and rearrange the print codes onto addresses on the print buffer E2014 that match the sequence of data transfer to the print head cartridge H1000 before transferring the codes (WDWP E2044). Reference number E2012 denotes a work area DMA controller which is controlled by the CPU E1001 through the CPU I/F E2001 to repetitively write specified work fill data (WDWF) E2042 into the area of the work buffer whose data transfer by the print buffer transfer DMA controller E2013 has been completed.

Designated E2015 is a print data development DMA controller E2015, which is controlled by the CPU E1001 through the CPU I/F E2001. Triggered by a data development timing signal E2050 from a head control unit E2018, the print data development DMA controller E2015 reads the print code that was rearranged and written into the print buffer and the development data written into the development data buffer E2016 and writes developed print data (RDHDG) E2045 into the column buffer E2017 as column buffer write data (WDHDG) E2047 The column buffer E2017 is an SRAM that temporarily stores the transfer data (developed print data) to be sent to the print head cartridge H1000, and is shared and managed by both the print data development DMA CONTROLLER and the head control unit through a handshake signal (not shown).

Designated E2018 is a head control unit E2018 which is controlled by the CPU E1001 through the CPU I/F E2001 to interface with the print head cartridge H1000 or the scanner through the head control signal. It also outputs a data development timing signal E2050 to the print data development DMA controller according to a head drive timing signal E2049 from the encoder signal processing unit E2019.

During the printing operation, the head control unit E2018, when it receives the head drive timing signal E2049. reads developed print data (RDHD) E2048 from the column buffer and outputs the data to the print head cartridge H1000 as the head control signal E1021.

In the scanner reading mode, the head control unit E2018 DMA-transfers the input data (WDHD) E2053 received as the head control signal E1021 to the scanner input buffer E2024 on the DRAM E2005. Designated E2025 is a scanner data processing DMA controller E2025 which is controlled by the CPU E1001 through the CPU I/F E2001 to read input buffer read data (RDAV) E2054 stored in the scanner input buffer E2024 and writes the averaged data (WDAV) P2055 into the scanner data buffer E2026 on the DRAM E2005.

Designated E2027 is a scanner data compression DMA controller which is controlled by the CPU E1001 through the CPU I/F E2001 to read processed data (RDYC) E2056 on the scanner data buffer E2026, perform data compression, and write the compressed data (WDYC) E2057 into the output buffer E2028 for transfer.

Designated E2019 is an encoder signal processing unit which, when it receives an encoder signal (ENC), outputs the head drive timing signal E2049 according to a mode determined by the CPU E10001. The encoder signal processing unit E2019 also stores in a register information on the position and speed of the carriage M4001 obtained from the encoder signal E1020 and presents it to the CPU E1001. Based on this information, the CPU E1001 determines various parameters for the CR motor E0001. Designated E2020 is a CR motor control unit which is controlled by the CPU E1001 through the CPU I/F E2001 to output the CR motor control signal E1036.

Denoted E2022 is a sensor signal processing unit which receives detection signals E1032, E1025, E1026 and E1027 output from the PG sensor E0010, the PE sensor E0007, the ASF sensor E0009 and the gap sensor E0008, respectively, and transfers these sensor information to the CPU E1001 according to the mode determined by the CPU E1001. The sensor signal processing unit E2022 also outputs a sensor detection signal E2052 to a DMA controller E2021 for controlling LF/PG motor The DMA controller E2021 for controlling LF/PG motor is controlled by the CPU E1001 through the CPU I/F E2001 to read a pulse motor drive table (RDPM) E2051 from the motor control buffer E2023 on the DRAM E2005 and output a pulse motor control signal E1033. Depending on the operation mode, the controller outputs the pulse motor control signal E1033 upon reception of the sensor detection signal as a control trigger.

Designated E2030 is an LED control unit which is controlled by the CPU E1001 through the CPU I/F E2001 to output an LED drive signal E1038. Further, designated E2029 is a port control unit which is controlled by the CPU E1001 through the CPU I/F E2001 to output the head power ON signal E1022, the motor power ON signal E1023 and the power supply control signal E1024.

[Operation of Printer]

Figure 10:
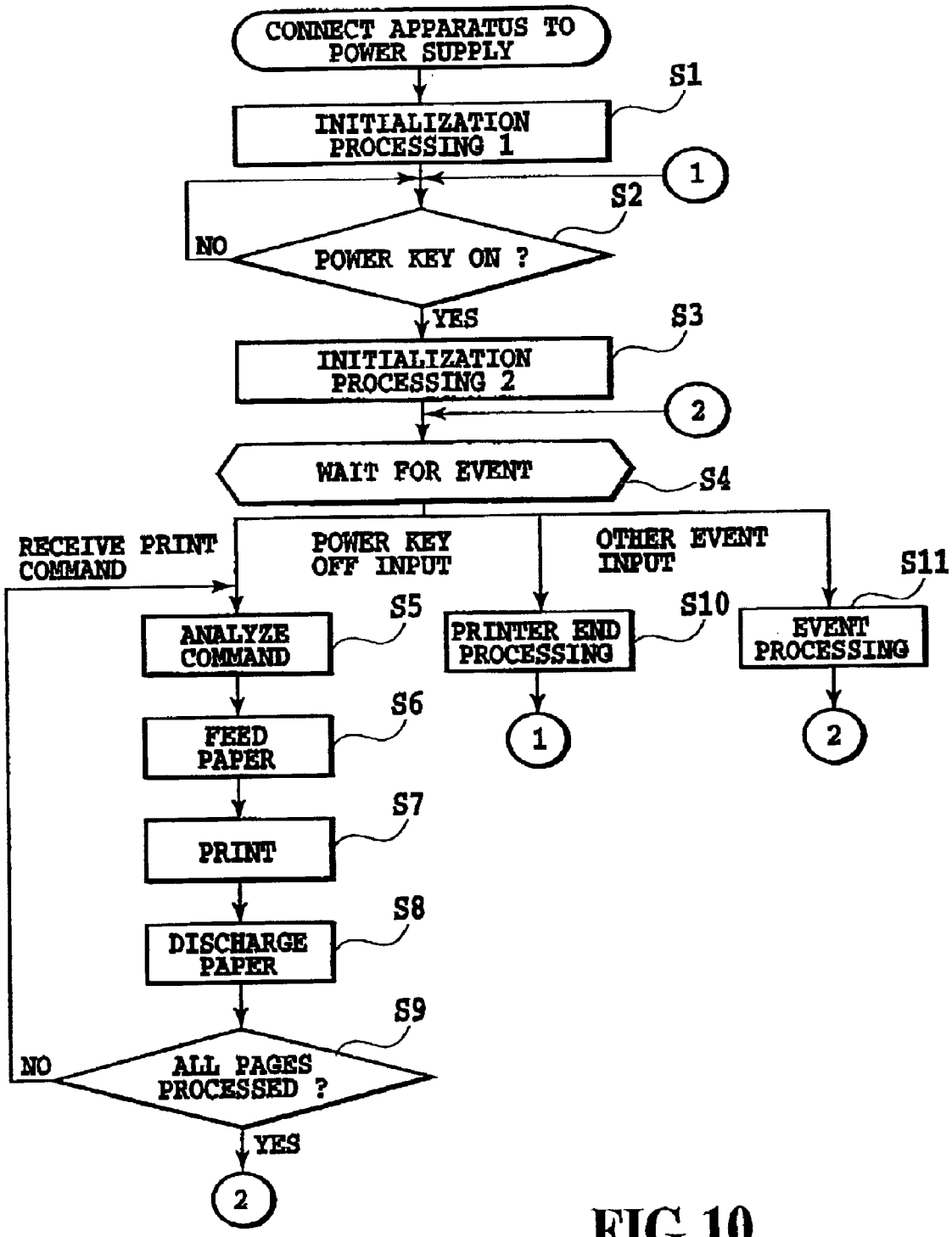
FIG. 10 is a flow chart showing an example of operation of the printer as one embodiment of the present invention.

Next the operation of the ink jet printing apparatus in this embodiment of the invention with the above configuration will be explained by referring to the flow chart of FIG. 10.

When the printer body M1000 is connected to an AC power supply, a first initialization is performed at step S1. In this initialization process, the electric circuit system including the ROM and RAM in the apparatus is checked to confirm that the apparatus is electrically operable.

Next, step S2 checks if the power key E0018 on the upper case M1002 of the printer body M1000 is turned on. When it is decided that the power key E0018 is pressed, the processing moves to the next step S3 where a second initialization is performed.

In this second initialization, a check is made of various drive mechanisms and the print head of this apparatus. That is, when various motors are initialized and head information is read, it is checked whether the apparatus is normally operable.

Next, steps S4 waits for an event. That is, this step monitors a demand event from the external I/F, a panel key event from the user operation and an internal control event and, when any of these events occurs, executes the corresponding processing.

When, for example, step S4 receives a print command event from the external I/F, the processing moves to step S5. When a power key event from the user operation occurs at step S4, the processing moves to step S10. If another event occurs, the processing moves to step S11.

Step S5 analyzes the print command from the external I/F, checks a specified paper kind, paper size, print quality, paper feeding method and others, and stores data representing the check result into the DRAM E2005 of the apparatus before proceeding to step S6.

Next, step S6 starts feeding the paper according to the paper feeding method specified by the step S5 until the paper is situated at the print start position. The processing moves to step S7.

At step S7 the printing operation is performed. In this printing operation, the print data sent from the external I/F is stored temporarily in the print buffer. Then, the CR motor E0001 is started to move the carriage M4001 in the main-scanning direction. At the same time, the print data stored in the print buffer E2014 is transferred to the print head H1001 to print one line. When one line of the print data has been printed, the LF motor E0002 is driven to rotate the LF roller M3001 to transport the paper in the sub-scanning direction. After this, the above operation is executed repetitively until one page of the print data from the external I/F is completely printed, at which time the processing moves to step S8.

Processing for print data with suppressing the number of used ejection openings and processing of generating print data with a mask process, for printing an edge area of a printing medium, are executed by a printer driver in a host apparatus through an outer interface and control processing for transporting the printing medium with suppressing the number of the ejection openings is executed by printing control in step S7 These processing will be explained referring to FIG. 12 and succeeding drawings as the embodiments of the present invention.

At step S8, the LF motor E0002 is driven to rotate the paper discharge roller M2003 to feed the paper until it is decided that the paper is completely fed out of the apparatus, at which time the paper is completely discharged onto the paper discharge tray M1004.

Next at step S9, it is checked whether all the pages that need to be printed have been printed and if there are pages that remain to be printed, the processing returns to step S5 and the steps S5 to S9 are repeated. When all the pages that need to be printed have been printed, the print operation is ended and the processing moves to step S4 waiting for the next event.

Step S10 performs the printing termination processing to stop the operation of the apparatus. That is, to turn off various motors and print head, this step renders the apparatus ready to be cut off from power supply and then turns off power, before moving to step S4 waiting for the next event.

Step S11 performs other event processing. For example, this step performs processing corresponding to the ejection performance recovery command from various panel keys or external I/F and the ejection performance recovery event that occurs internally. After the recovery processing is finished, the printer operation moves to step S4 waiting for the next event.

An embodiment to which the present invention is effectively applied is a form of a printing head that ejects ink by a pressure of a bubble from a film boiling generated by utilizing thermal energy generated from an electro-thermal converter.

Embodiment 1

Description will be given of a first embodiment of margin-less printing executed by the ink jet printer of this embodiment, described above with reference to FIGS. 1 to 10.

Figure 11:
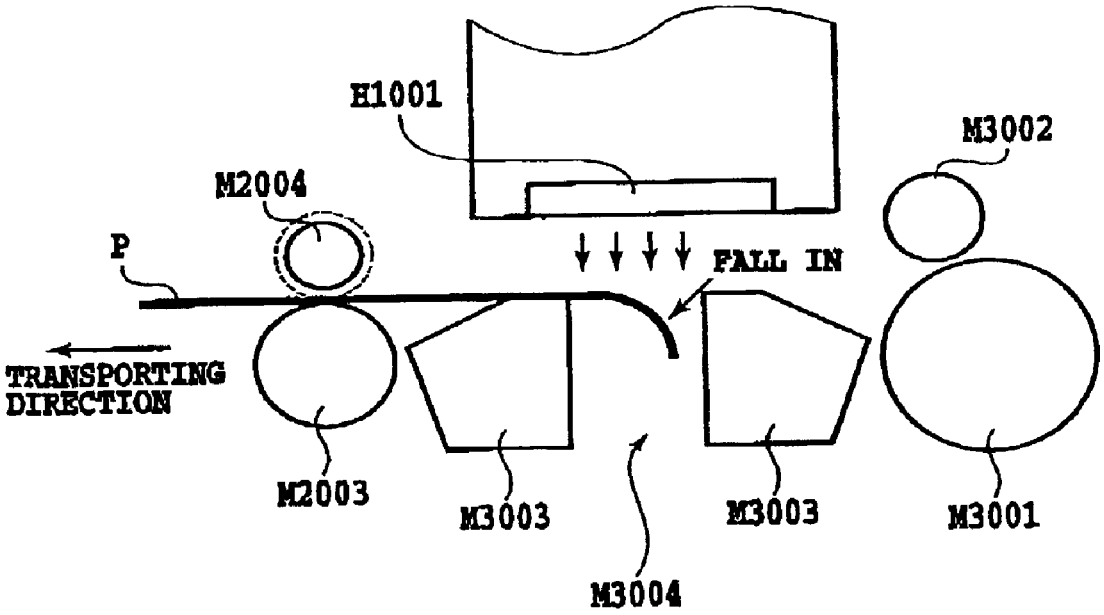
FIG. 11 is a diagram showing a gap formed in a printing medium transportation path in an ink jet printer according to an embodiment of the present invention and more specifically formed in a platen rib.

FIG. 11 is a side view showing a portion of a printing area in which the printing head performs a scanning operation, within printing medium transportation path in a printer of this embodiment. This figure is showing that a trailing edge area of a printing medium P is subjected to margin-less printing. The margin-less printing according to this embodiment is similarly applicable whether the trailing or leading edge area of the printing medium is printed, as is apparent from the description below. In this regard, the term "edge" or "edge area" refers both printing areas relating to the leading and trailing edge areas of the printing medium, unless otherwise specified.

As shown in FIG. 11, a platen rib M3003 is provided with a gap M3004. The gap M3004 extends in a scanning direction (the direction perpendicular to the sheet of the drawing) of a printing head H1001, and an ink absorbing member is provided inside the gap. Thus, the ink absorbing member, provided inside the gap corrects most of the ink ejected out of the printing medium when an edge area located close to an edge of the printing medium P is printed through scanning operations performed by the printing head H1001.

In a transportation path, a transportation roller M3001 and a pinch roller M3002 that presses the printing medium P against the transportation roller M3001 to exert transportation force are provided on an upstream side of the platen rib M3003. Further, a sheet discharging roller M2003 and a spur M2004 exerting transportation force similarly are provided on a downstream side of the platen rib M3003. When the printing medium P is held by both pairs of rollers, which are provided across a printing area of the printing head, a specified transportation accuracy or higher is ensured. In this specification, an area, defined as an area on the printing medium P, in which the specified transportation accuracy or higher is ensured is called a "normal area". In contrast, when the printing medium P is held by only the pair including the transportation roller M3001 and not by the pair including the sheet discharging roller M2003, i.e. a leading portion of the printing medium P is printed, or when a trailing portion, held by only the pair including the sheet discharging roller M2003, is printed as shown in the figure, the transportation accuracy decreases. In this specification, this area is called a "low-accuracy area". Furthermore, in an area, the transportation accuracy may be low in connection with printing of an edge area of the printing medium P, as in the low-accuracy area, and ink may be ejected out from the printing medium P for margin-less printing. In this specification, this area is called an "edge area". More specifically, the edge area includes both an area extending out from the edge of the printing medium in its transportation direction (a first part) and an area on the printing medium which is located inside this edge (a second part).

More specifically, for the above areas (normal, low-accuracy, and edge areas), a boundary position or a width of area of each area relative to the printing head H1001 is managed according to an amount of rotations of a transportation motor driving the transportation roller M3001 to a reference of what is called head determining process or detection of the leading head of the printing medium. In particular, the edge area is defined as an area of a size equal to a value obtained by adding a transportation error and a size error in the printing medium, for both the upstream and downstream side of the transportation direction, to the position of the edge of the printing medium, which is at a predetermined position relative to the printing head H1001. The errors added for the upstream and downstream sides of the transportation direction need not be equal. Of course, these values depend on possible transportation errors in the printer or errors in the size of the printing medium used.

For margin-less printing, ink must be also ejected out of the printing medium in a width direction of the transported printing medium P, i.e. in the scanning direction of the printing head. For this purpose, although not shown in FIG. 11, an ink absorbing member is also provided at respective positions corresponding to edges of the printing medium P in its width direction, which is transported on the platen. Further, in this embodiment, extra printing data is generated which corresponds to the printing out of the printing medium in its width direction. In this regard, the original print data may be simply enlarged so as to extend out from the printing medium. On the other hand, printing data corresponding to the edge area, described above for margin-less printing, is shown below.

Figure 12:
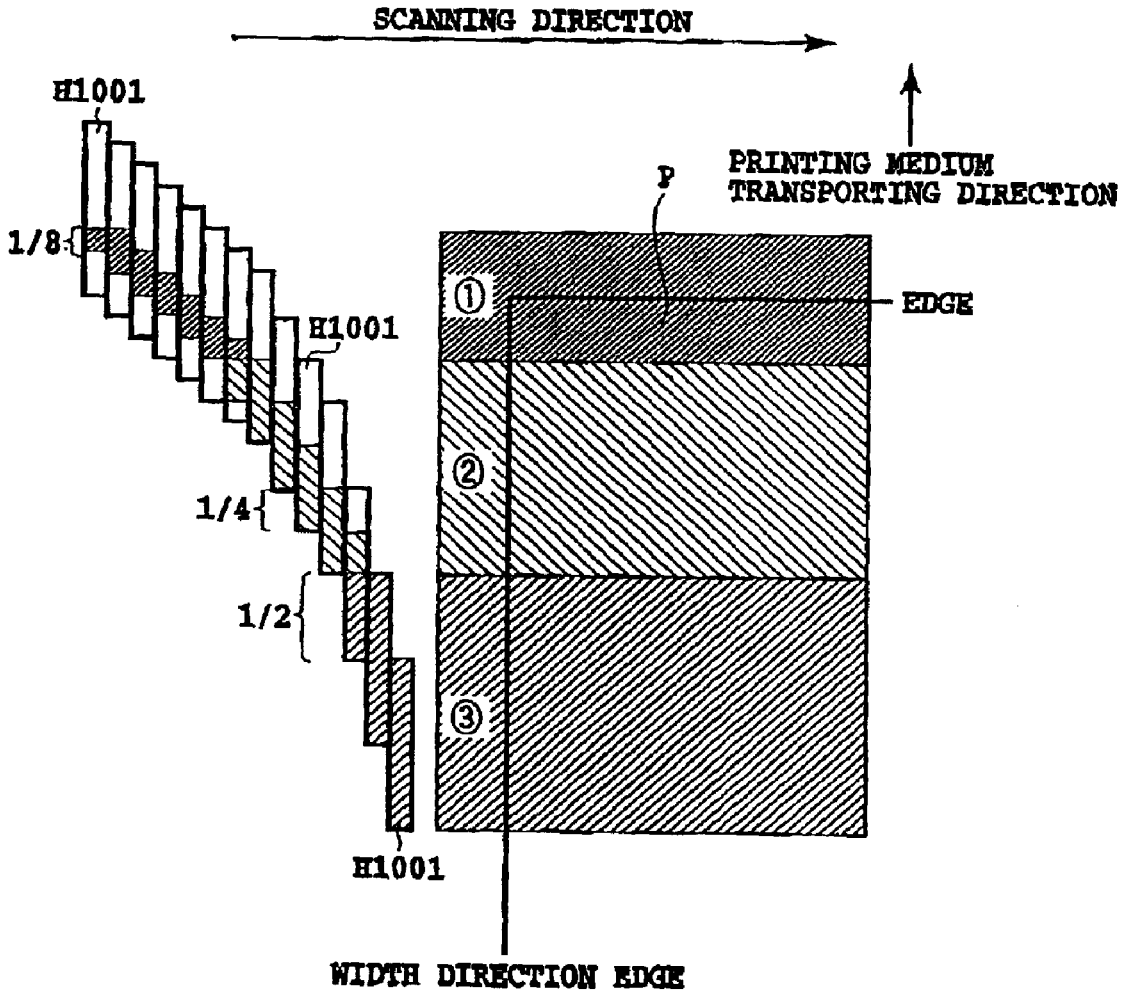
FIG. 12 is a diagram illustrating a printing method according to a first embodiment of the present invention.

FIG. 12 is a diagram illustrating a printing method according to the first embodiment of the present invention. In particular, this figure shows ranges of the ejection openings (shaded and other non-white parts) in the printing head H1001 which are used when the normal area ③, low-accuracy area ②, and edge area ①, described above, are printed, respectively.

As shown in this figure, in this embodiment, what is called multi-pass printing of two-pass is carried out, in which the same pixel row in each area is completed by causing the printing head to scan this pixel row twice. In this case, to print the same pixel row using different ejection openings, the printing medium is transported in the transportation direction between scanning operations so that the different ejection openings correspond to the same pixel row during the respective scanning operations. In the figure, a position of the printing head is shown varying with the scanning operation. However, this is for simplification of illustration. Actually, the position of the printing head H1001 is fixed in its transportation direction, and the printing medium P moves in a printing medium transportation direction (a direction crossing at right angles to the scanning direction of the printing head) by amounts corresponding to the ranges of ejection openings used, shown by the shaded and other non-white parts.

As is apparent from FIG. 12, in this embodiment, in the respective areas, the printing medium is transported by different amounts and different numbers of ejection openings (ranges of ejection openings used) are used for one scanning operation performed by the printing head. More specifically, when the normal area ③ is printed, all ejection openings are used for one scanning operation. In contrast, when the edge area ① is printed, one-fourth of all ejection openings are used for one scanning operation. That is, when the edge area ① is printed, a smaller number of ejection openings than that used when the normal area ③ is printed are used for one scanning operation. Further, for the amount by which the printing medium is transported between scanning operations, the transportation amount in the normal area ③ corresponds to half the entire width of the ejection opening row, whereas the transportation amount in the edge area ① corresponds to one eighth of the entire width of the ejection opening row. That is, the transportation amount in the edge area ① is one-fourth of that in the normal area ③. Thus, the transportation amount decreases consistently with the number of ejection openings used.

Thus, a decrease in number of ejection openings used for one scanning operation in the edge area reduces the amount of ink ejected out of the printing medium during one scanning operation. This in turn reduces the amount of ink mist that may scatter or float without being captured by the ink absorbing member in the gap. This is particularly effective because if the size of or the positional relationship between the elements of the printer such as the platen is such that scattering ink or floating mist may adhere to these elements or the printing medium in a relatively short time, the amount of scattering ink or ink mist itself can be reduced.

Ink mist may be generated not only in the edge area but also in the normal area. Accordingly, if priority is given to a reduction in ink mist, it is assumed that a small number of ejection openings as few as those used to print the edge area are desirably used to print the normal area. However, this embodiment does not employ such an arrangement but an arrangement in which the number of ejection openings used in the edge area is reduced compared to those used to print the normal area. The reason is shown below.

As previously described, a method in which a small number of ejection openings as few as those used to print the edge area are used to print the normal area may be excellent in a reduction in amount of mist. However, in this method, because of the small number of ejection openings used in the normal area, printing speed decreases. Since the printing speed is an important factor of the printer, a decrease in printing speed should be minimized. On the other hand, for the printing speed, printing is preferably carried out using as many ejection openings as possible whether the normal or edge area is printed. However, this method may increase the amount of ink mist. As is apparent from the above description, the printing speed decreases if printing is carried out using a smaller number of ejection openings in order to reduce the amount of mist. On the other hand, the amount of mist increases if printing is carried out using a larger number of ejection openings in order to increase the printing speed. Accordingly, there is a tradeoff relationship between a reduction in amount of mist and an increase in printing speed. Consequently, it has been assumed to be difficult to simultaneously meet these inconsistent requirements, a reduction in amount of mist and an increase in printing speed.

However, the inventors focused on the point that these inconsistent requirements must be simultaneously met, i.e. the amount of mist must be sufficiently reduced while minimizing a decrease in printing speed, in order to improve image quality while increasing printing speed. The inventors thus conducted wholehearted studies In order to simultaneously meet these inconsistent requirements. As a result, first, the inventors found that when the edge area is printed, a large amount of mist is generated, requiring measures to be taken to reduce the amount of mist, as previously described, but that when the normal area is printed, only a small amount of mist is generated, eliminating the need to take measures to reduce the amount of mist. Then, the inventors minimized a reduction in number of ejection openings used to print the normal areas, for which no measures need to be taken to reduce the amount of mist, so as to minimize a decrease in printing speed. On the other hand, the inventors reduced the number of ejection openings used to print the edge area, for which measures must be taken to reduce the amount of mist, so as to sufficiently reduce the amount of mist. According to the arrangement of this embodiment, the amount of mist can be sufficiently reduced in the edge area, in which the ink mist problem is likely to occur. Consequently, the amount of mist can be reduced in the entire print area including the edge area and the normal area. Further, in the edge area, the number of ejection openings used is reduced and thus the printing speed decreases slightly. However, in the normal area, the number of ejection openings is not reduced and the printing speed does not decrease. Overall, the printing speed does not decrease significantly. That is, this method serves to simultaneously meet the inconsistent requirements, i.e. sufficiently reduce the amount of mist while minimizing a decrease in printing speed.

In FIG. 12, the number of ejection openings used is reduced not only in the edge area ① but also in the low-accuracy area ② compared to the normal area ③ (half of all ejection openings). This is to reduce the transportation amount and thus the magnitude of transportation errors. This enables a reduction of positional deviation of ink dots formed in the low-accuracy area.

Further, in the above description, the number of ejection openings used and the transportation amount is varied between the low-accuracy area ② and the edge area ①. However, these may be the same in both areas. That is, in this embodiment, it is only necessary that the number of ejection openings used and the transportation amount for one scanning operation in the edge area ① are smaller than those in the normal area ③. The number of ejection openings used and the transportation amount ② may be the same as those in the edge area ①.

Furthermore, the illustrated example relates to a marginless printing method, executed at the leading edge area of the printing medium. However, it can be easily understood that this method can be similarly executed at the trailing edge area by, for example, reversing the transportation direction in the figure so that a leading edge of the printing medium is placed at the position of a trailing edge, vice versa.

According to this embodiment, described above, the number of ejection openings used (the range of ejection openings used) is reduced in the edge area, in which ink mist is likely to occur, compared to the normal area, in which ink mist is relatively unlikely to occur. Accordingly, the amount of mist can be sufficiently reduced while minimizing a decrease in printing speed.

(Variation of Embodiment 1)

In the first embodiment, to reduce the amount of ink ejected to the edge area during one scanning operation below the amount of ink ejected to the normal area during one scanning operation, the number of ejection openings used for one scanning operation in the edge area is reduced compared to the normal area. In this case, what is called multi-pass printing of two-pass is carried out, in which the same pixel row in each area is completed by causing the printing head to scan this pixel row twice. That is, the same two-pass printing is carried out in both edge area and normal area.

However, the amount of ink ejected to the edge area during one scanning operation can also be reduced by increasing the number of passes in the edge area compared to the normal area. In this embodiment, to reduce the amount of ink ejected to the edge area during one scanning operation below the amount of ink ejected to the normal area during one scanning operation, i) the number of ejection openings used for one scanning operation in the edge area is reduced compared to the normal area, and ii) the number of passes required to complete the same pixel row in the edge area is increased compared to the normal area.

Then, an example of this variation will be described. First, the restrictions on the number of ejection openings used (the range of ejection openings used) in i) may be similar to those described in the first embodiment. The number of ejection openings used for the edge area is limited to one-fourth of the number of ejection openings used for the normal area. Then, for the number of passes in ii), the same pixel row in the normal area is completed using two passes, whereas the same pixel row in the normal area is completed using four passes. This is accomplished by reducing the transportation amount in the edge area ① to one-eighth of the transportation amount in the normal area ③. In this arrangement, the number of passes in the low-accuracy area ② may be two as with the normal area ③ or four as with the edge area ①.

Further, the number of passes may increase from the normal area ③ through the low-accuracy area ② to the edge area ①. For example, two passes may be executed in the normal area ③, four passes, in the low-accuracy area ②, and eight passes, in the edge area ①.

According to the arrangement of the above described variation, in the edge area, the number of ejection openings used is reduced, with the number of passes increased. This reduces the amount of ink ejected to the edge area during one scanning operation. This in turn efficiently suppresses the occurrence of ink mist in the edge area.

Embodiment 2

In this embodiment, the number of scanning operations in the edge area is reduced compared to the other areas, thereby reducing the time required to print the edge area. Thus, compared to the case in which more scanning operations are performed, the total amount of ink ejected remains the same, but the time for which mist floats, which results from ink ejected out of the printing medium during printing of the edge area, is reduced. This also reduces the time for which the printing medium remains in a space in which such mist floats.

Figure 13:
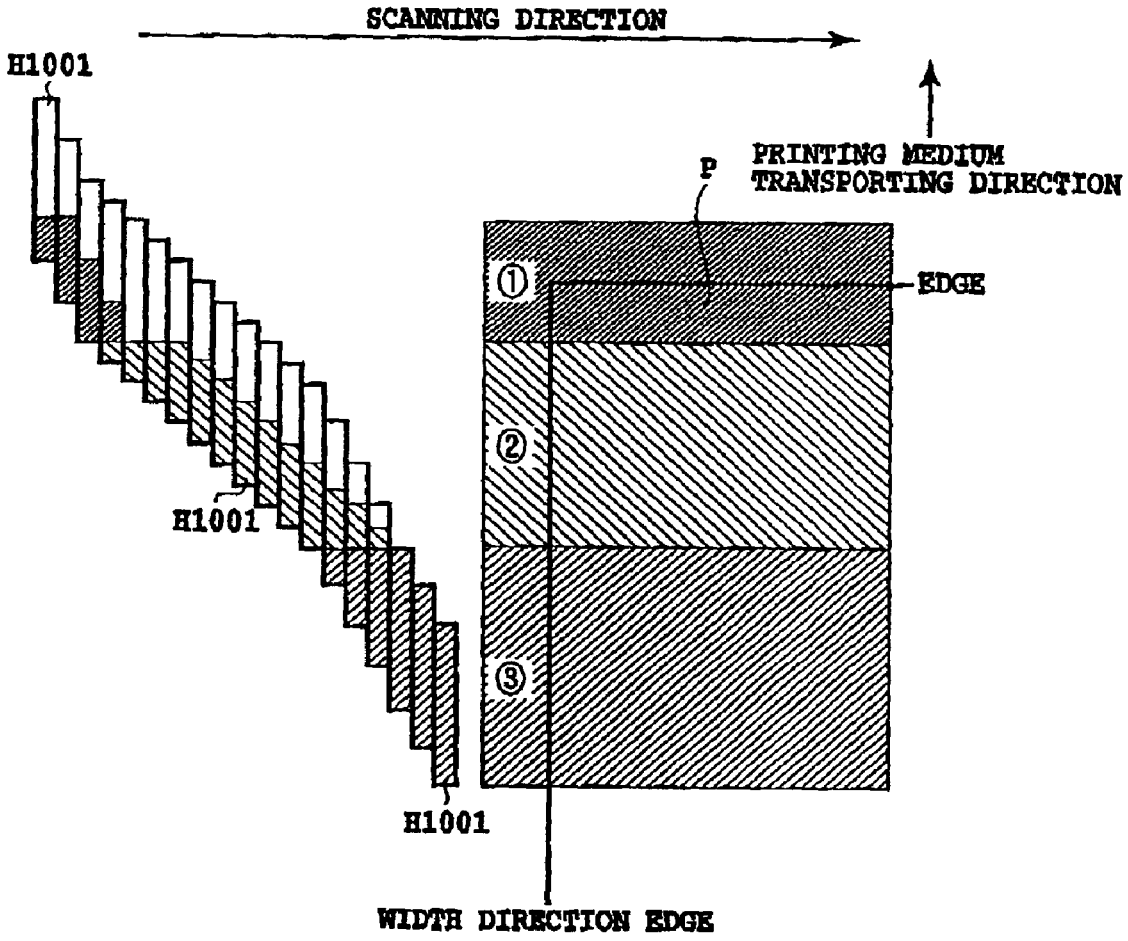
FIG. 13 is a diagram illustrating a printing method according to a second embodiment of the present invention.
Figure 14A:
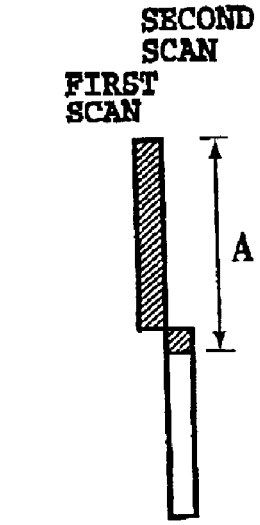
FIGS. 14A–14D are diagrams showing a relationship between the number of passes for multi-pass printing and the number of scanning operations (time) when an edge area is printed, according to the second embodiment.
Figure 14B:
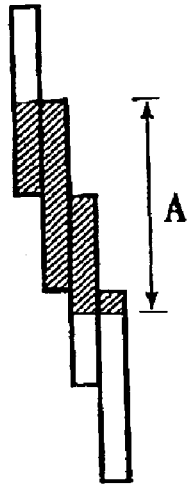
Figure 14C:
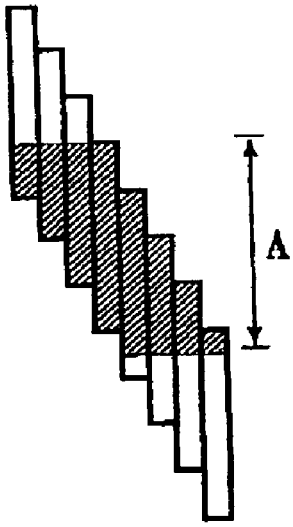
Figure 14D:
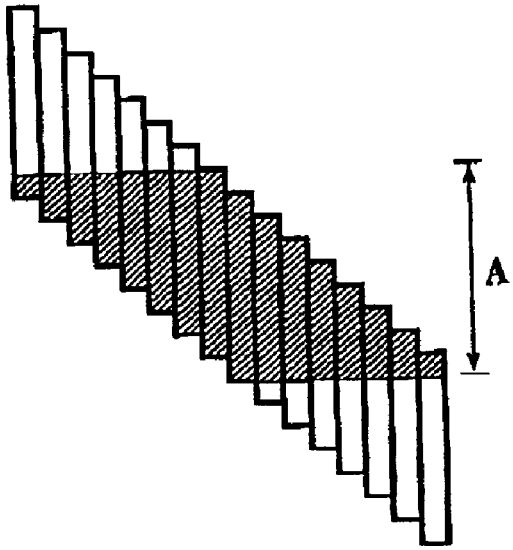

FIG. 13 is a diagram illustrating a printing method according to this embodiment. As shown in this figure, four scanning operations are required to complete printing each of the normal area ③ and the low-accuracy area ②, whereas only two scanning operations are required to complete printing the edge area ①. In the illustrated example, the time required to print the edge area ① corresponds to four scanning operations and is half the time required to print an area of the same size in the other areas. This reduces the possibility that floating mist or the like is further diffused, for example, owing to air currents or the like caused by a scanning operation of the printing head or that mist adheres to the printing medium In particular, the printing medium is charged because of friction or the like, whereas ink mist is also slightly charged, so that the mist is often attracted and adheres to the printing medium owing to static electricity. However, when the number of scanning operations in the edge area is reduced as described above, the time for which the printing medium remains in the space in which mist floats is shortened to reduce the amount of mist adhering to the printing medium.

FIGS. 14A–14D are diagrams showing the number of passes for multi-pass printing and the total number of scanning operations (time) used when a predetermined width A in the edge area is printed. As shown in this figure, the time required to print the edge area increases linearly with the number of passes for multi-pass printing.

In this embodiment, control is provided to reduce the range of ejection openings used in order to reduce the positional deviation of dots in the low-accuracy area, as in the case of Embodiment 1.

Embodiment 3

In this embodiment, the amount of floating mist is reduced by using a mask different from the one used for the normal area and low-accuracy area, to subject the edge area to multi-pass printing.

Figure 15:
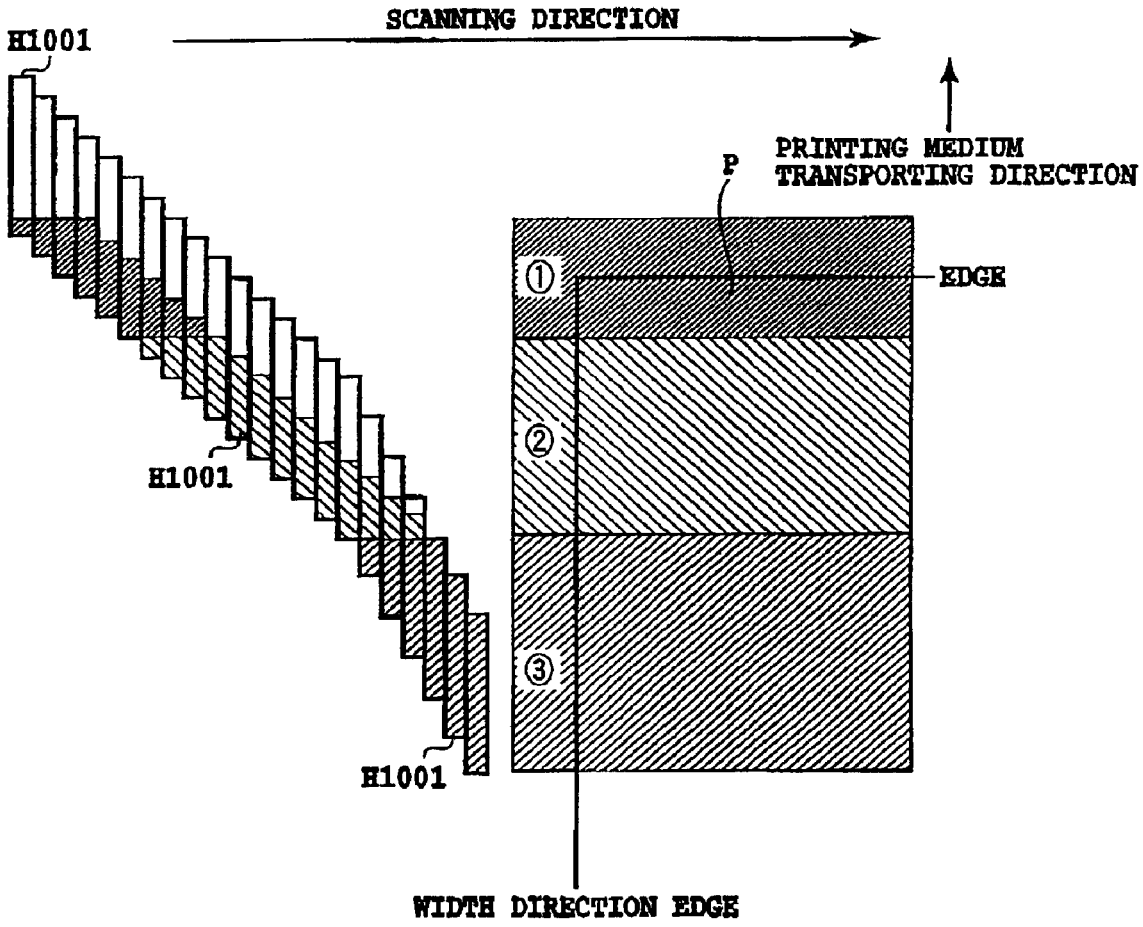
FIG. 15 is a diagram illustrating a printing method according to a third embodiment of the present invention.
Figure 16A:
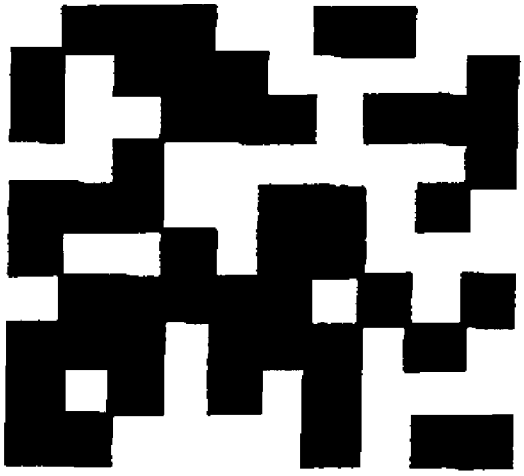
FIGS. 16A and 16B are diagrams schematically showing masks used in an area other than the edge area according to the third embodiment.
Figure 16B:
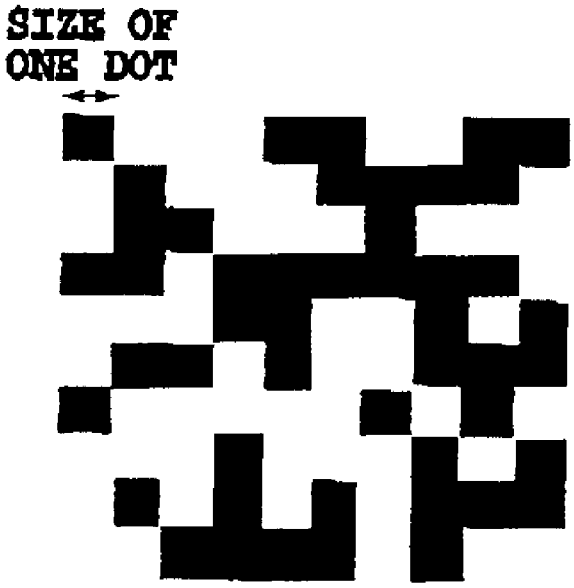
Figure 17:
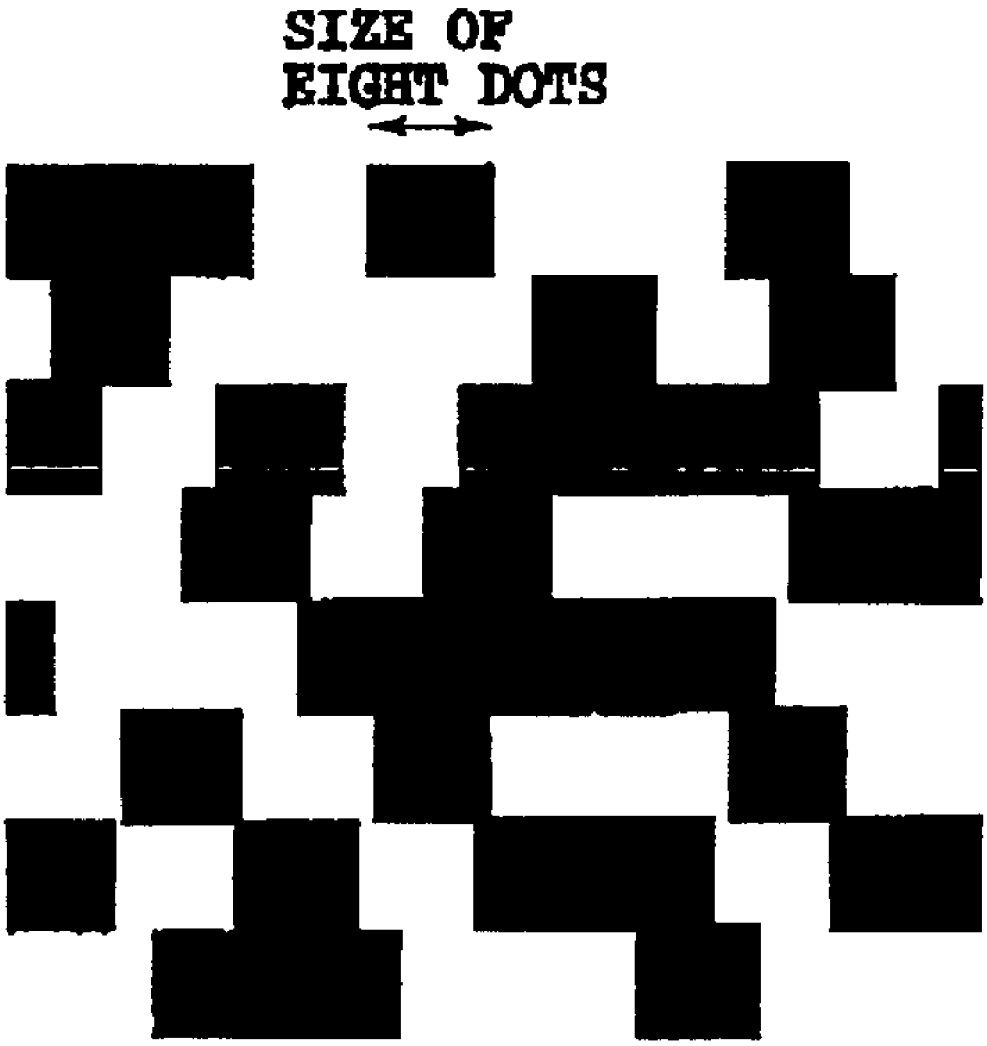
FIG. 17 is a diagram schematically showing a mask used for the edge area according to the third embodiment.

FIG. 15 is a diagram illustrating a printing method according to this embodiment. As shown in this figure, multi-pass printing of four-pass is carried out in each area (normal area, low-accuracy area, and edge area). However, mask processing executed to generate print data for each range of ejection openings used varies between the edge area ① and both low-accuracy area ② and normal area ③. FIGS. 16A and 16B show thinning masts used to distribute print data to two scanning operations and are formed so that a mask used for the first pass (FIG. 16A) and a mask used for the second pass (FIG. 16B) are complementary to each other and then the corresponding print areas are 100% complementary to each other. Further, FIG. 17 shows a thinning mask used to distribute print data to two scanning operations. In this case, only the mask used for the first pass is shown, whereas a mask used for the second pass is omitted. However, the mask used during the second pass is complementary to the mask used during the first pass.

More specifically, basically, in the low-accuracy area ② and normal area ③, masks (in FIGS. 16A and 16B, masks for two pass printing are shown for simplification) are used such that print data is distributed for one pixel unit (an area corresponding to a square composed of 1 dot size×1 dot size in the figure) corresponding to one ink dot to execute printing during two scanning operations, as shown in FIGS. 16A and 16B. On the other hand, in this embodiment, as shown in FIG. 17, masks used are such that during a single scanning operation, for example, an eight-pixel unit (an area corresponding to a square composed of 8 dot size×8 dot size), which is larger than one pixel, is used for printing and that print data is distributed over two scanning operations This mask processing is executed for eight pixels as a minimum unit to generate print data. Ink ejection based on this processing serves to increase the number of ink droplets flying very nearby compared to the mask processing shown in FIGS. 16A and 16B. Thus, the group of ink droplets are attracted to one another owing to air currents generated by themselves. This reduces the amount of scattering or floating ink or ink mist.

In the normal area or low-accuracy area, when cluster size (minimum mask unit) is increased in order to reduce the amount of floating mist or for another reason, non-uniformity of colors because of the reciprocating scanning operations or a granular appearance may occur in a print image. To avoid this, a one-pixel unit or a minimum unit close thereto is used.

Further, in the above description, as shown in FIG. 17, the cluster size of the mask (minimum mask unit) that enables ink ejection to concentrate in a predetermined area during the same pass is shaped like a square. However, the present invention is not limited to this aspect, but a rectangular may also be used. That is, in the above description, the minimum management unit of the mask is an area corresponding to a square composed of 8×8 pixels. However, the minimum management unit of the mask may be an area corresponding to a rectangle composed of for example 2×4 pixels.

According to this embodiment, described above, in the edge area, in which ink mist is likely to occur compared to the normal area, a mask with a large minimum management unit is used to enable ink-ejection to concentrate in a predetermined area during the same pass, thereby reducing the amount of ink mist in the edge area.

Embodiment 4

In a fourth embodiment of the present invention, masks used for multi-pass printing in the edge area are such that a printed image has a density decreasing toward the edge and that the entire image has a lower density.

More specifically, when four-pass multi-pass printing is carried out in the edge areas masks used to print data corresponding to this edge area are such that the mask for the first scanning operation has a ⅛ duty, the mask for the second scanning operation has a 1/6 duty, the mask for the third scanning operation has a ¼ duty, the mask for the fourth scanning operation similarly has a ¼ duty, and the total duty is less than 100% (in this case, $(1/8+1/16+1/4+1/4)\times 100$=about 79% duty) and that the duty of each scanning operation decreases toward the edge.

In this manner, the multi-pass printing operations in the edge area are not perfectly complementary to one another. This reduces the amount of ink ejected to the edge area, thereby reducing the amount of floating ink mist as described in Embodiment 1. Further, since the masks are such that the duty decreases toward the edge of the printing medium, the amount of ink likely to be ejected out of the printing medium is reduced, thereby similarly reducing the amount of floating ink mist.

Instead of the masks causing the duty to decrease toward the edge, those which uniformly thin data in the edge area may be used to reduce the amount of ink ejected throughout the multi-pass printing as long as the masks are not perfectly complementary to one another.

Further, an edge portion may be gradated to white as a result of the above mask processing. However, the width of the edge area to which ink is also ejected out from the edge of the printing medium is determined under the assumption of the worst conditions for the transportation accuracy or errors in printing medium size as previously described. Consequently, these conditions are unlikely to occur, and thus the above described gradation printing rarely occurs. Further even if the duty for the edge area, i.e. the amount of ink landing the printing medium is reduced to about 79% as described above, this is insignificant in relation to the print image as a whole.

Embodiment 5

Basically, in this embodiment, the amount ink mist is reduced by decreasing the number of ejection openings used for the edge area as with Embodiment 1. Further, a mask pattern used for multi-pass printing is the same as or similar to that used for the normal area or low-accuracy area .

Figure 18:
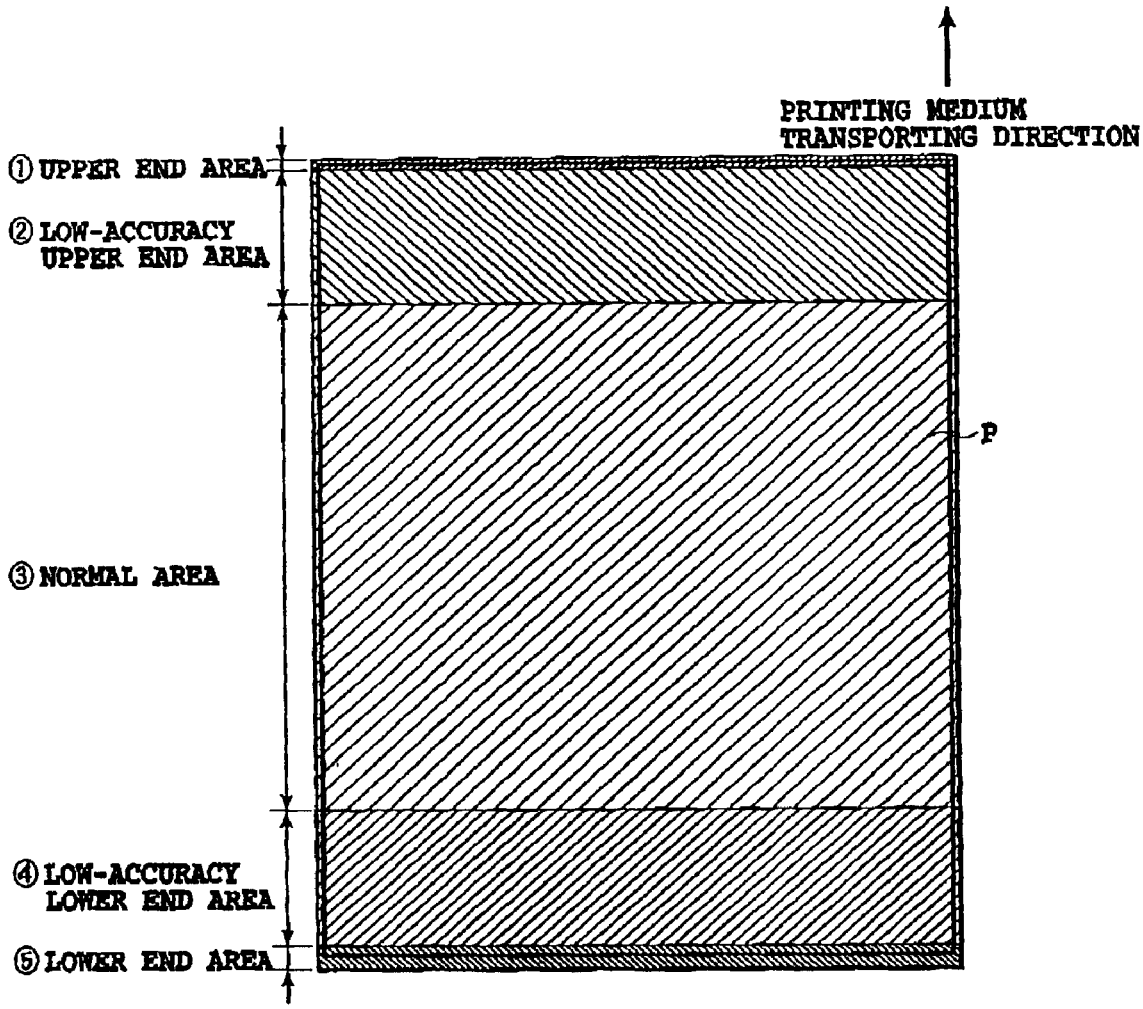
FIG. 18 is a diagram illustrating printing methods according to a fifth and sixth embodiments of the present invention.

FIG. 18 shows areas in which different printing control is provided. This figure shows an edge area at a leading end of the printing medium (upper edge area ①), a low-accuracy area also at the leading end (low-accuracy upper edge area ②), a normal area ③, a low-accuracy area at a trailing end of the printing medium (low-accuracy lower edge area ④), and an edge area at the trailing end (lower edge area ⑤).

In the normal area and the low-accuracy areas, masks are used which cause the amount of ink ejected to decrease at an end portion of the area printed during each scanning operation of multi-pass printing and which are perfectly complementary to each other during the passes in which that area is printed, i.e. the masks causing the duty to decrease toward the end portion.

On the other hand, in the edge area, the number of ejection openings used is reduced as in Embodiment 1, and the distribution of the duty of the masks used is the same as or similar to that used for the normal area and others. This prevents a difference in density from occurring before or after one of the areas ① to ⑤ shown in FIG. 18 changes to another.

Embodiment 6

Basically, in this embodiment, the number of ejection openings used is reduced as with Embodiment 5, described above, and the same or similar masks are used in the areas ① to ⑤, shown in FIG. 18. More specifically, the masks with the concentrated dot size (cluster size) distribution shown in Embodiment 3 are used in the normal area or low-accuracy area.

A change in mask cluster size may cause a change in tone such as reciprocation non-uniformity attributed to the order of landing color inks. This change may be marked depending on the type of the printing medium. Thus, in this embodiment, for printing of the edge area, the number of ejection openings used is reduced and the mask cluster size used is the same as or similar to that used in the normal area or low-accuracy area. This prevents a noticeable tone or density difference from occurring where one area changes to another.

Other Embodiments

Embodiments 1 and 2 or 2 and 3 may be combined together. This also reduces the amount of floating ink mist or the like or the amount of mist adhering to the printing medium.

Further, in Embodiments 1 to 3, control of printing of the low-accuracy area ② may be the same as that of the edge area ① or normal area ③.

Further Embodiments

As described above, the present invention is applicable either to a system comprising plural pieces of device (such as a host computer, interface device, a reader, and a printer, for example) or to an apparatus comprising one piece of device (for example, a copy machine or facsimile terminal device).

Additionally, an embodiment is also included in the category of the present invention, wherein program codes of software such as those shown in FIGS. 12–18, for example, which realize the above described embodiments, are supplied to a computer in an apparatus or a system connected to various devices to operate these devices so as to implement the functions of the above described embodiments, so that the various devices are operated in accordance with the programs stored in the computer (CPU or MPU) of the system or apparatus.

In this case, the program codes of the software themselves implement the functions of the above described embodiments, so that the program codes themselves and means for supplying them to the computer, for example, a storage medium storing such program codes constitute the present invention.

The storage medium storing such program codes may be, for example, a floppy disk, a hard disk, an optical disk, a magneto-optical disk, a CD-ROM, a magnetic tape, a non-volatile memory card, or a ROM.

In addition, if the functions of the above described embodiments are implemented not only by the computer by executing the supplied program codes but also through cooperation between the program codes and an OS (Operating System) running in the computer, another application software, or the like, then these program codes are of course embraced in the embodiments of the present invention.

Furthermore, a case is of course embraced in the present invention, where after the supplied program codes have been stored in a memory provided in an expanded board in the computer or an expanded unit connected to the computer, a CPU or the like provided in the expanded board or expanded unit executes part or all of the actual process based on instructions in the program codes, thereby implementing the functions of the above described embodiments.

As is apparent from the above description, according to one embodiments of the present invention, for what is called margin-less printing, when printing is carried out for an edge area including both an area located out from an edge of a printing medium in a direction in which it is transported and an area located inside this edge, the amount of ink ejected to this area is reduced compared to an area other than the edge area (for example, a normal area). This reduces the amount of ink ejected out of the printing medium in the edge area. Further, in another embodiment, the number of scanning operations performed by the printing head over a predetermined width in the transportation direction is reduced compared to an area other than the edge area. This reduces the time for which mist generated while the printing medium remains in the edge area adheres to the printing medium. In yet another embodiment, a mask used to generate ejection data for each of the plurality of scanning operations for printing the edge area is differentiated from a mask for an area other than the edge area so that a minimum mask unit of the mask for the edge area is greater than that of the mask for the area other than the edge area. Consequently, ink ejected out of the printing medium in the edge area becomes a fixed mass. This reduces the amount of scattering ink or floating mist.

As a result, the contamination of elements of the apparatus or the printing medium caused by ink mist or the like which may scatter or float in the apparatus when margin-less printing is carried out.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing method of performing printing by repeating an operation of scanning a printing head having a plurality of ink ejection openings to a printing medium and an operation of transporting the printing medium, so as to eject ink from the printing head to the printing medium, said method comprising:

a providing step for providing a first roller located upstream of the printing head in a direction in which the printing medium is transported, so as to hold and transport the printing medium, and a second roller located downstream of the printing head in the transported direction of the printing medium, so as to hold and transport the printing medium;

a first printing step for, when the printing medium is in a state of not being held by said second roller but being held by said first roller, performing printing to both of a first area of the printing medium which extends out from a front edge of the printing medium in the transported direction and a second area on the printing medium which is located inside the front edge;

a second printing step for, when the printing medium is in a state of being held by said first and second rollers, performing printing only to the second area on the printing medium; and a third printing step for, when the printing medium is in a state of not being held by said second roller but being held by said first roller, performing printing only to the second area on the printing medium, wherein, when said first printing step performs printing, the number of ejection openings used for one scanning operation is reduced compared to when said second printing step performs printing, and wherein, when said third printing step performs printing, the number of the ejection openings used for one scanning operation is reduced compared to when said second printing step performs printing.

2. An ink jet printing method of performing printing by repeating an operation of scanning a printing head having a plurality of ink ejection openings to a printing medium and an operation of transporting the printing medium, so as to eject ink from the printing head to the printing medium, said method comprising:

a providing step for providing a first roller located upstream of the printing head in a direction in which the printing medium is transported, so as to hold and transport the printing medium, and a second roller located downstream of the printing head in the transported direction of the printing medium, so as to hold and transport the printing medium;

a first printing step for, when the printing medium is in a state of not being held by said second roller but being held by said first roller, performing printing to both of an area of the printing medium which extends out from a front edge of the printing medium in the transported direction and an area on the printing medium which is located inside the front edge;

a second printing step for, when the printing medium is in a state of being held by said first and second rollers, performing printing only to the area on the printing medium which is located inside the front edge; and an ejection opening control step for, when said first printing step performs printing, reducing the number of the ejection openings used for one scanning operation compared to when said second printing step performs printing, wherein said ejection opening control step causes only the ejection openings which are located on the printing head nearer to said first roller than said second roller, to be used so that the number of ejection openings is reduced.

3. An ink jet printing method as claimed in claim 2, wherein the number of times of scanning operation by the printing head, the number of times being required to complete a predetermined width in the edge area, is the same as the number of times of scanning operation by the printing head, the number of times being required to complete the predetermined width in an area on the printing medium which is other than the edge area.

4. An ink jet printing method as claimed in claim 2, wherein printing is performed by causing the printing head to execute a plurality of times of scanning operation for the same area of the printing medium, and a mask used for generating ejection data for each of the plurality of times of scanning operation for the edge area is different from the mask used in a case of printing for an area on the printing medium which is other than the edge area.

5. An ink jet printing method as claimed in claim 2, wherein printing is performed by causing the printing head to execute a plurality of times of scanning operation for the same area of the printing medium, and a mask, which is used for generating ejection data for each of the plurality of times of scanning operation, is used for generating ejection data for the edge area and has a duty decreasing from an interior to an edge of the printing medium.

6. An ink jet printing method as claimed in claim 2, wherein printing is performed by causing the printing head to execute a plurality of times of scanning operation for the same area of the printing medium, and a mask, which is used for generating ejection data for each of the plurality of times of scanning operation, is used for generating ejection data for each of the plurality of times of scanning operation for the edge area and has a lower duty at a position closer to an edge, in a transportation direction of the printing medium, of an area printed during the scanning operation.

7. An ink jet printing method of performing printing by repeating an operation of scanning a printing head having a plurality of ink ejection openings through to a printing medium and an operation of transporting the printing medium, so as to eject ink from the printing head to the printing medium, said method comprising:

a providing step for providing a first roller located upstream of the printing head in a direction in which the printing medium is transported, so as to hold and transport the printing medium, and a second roller located downstream of the printing head in the transported direction of the printing medium, so as to hold and transport the printing medium;

a first printing step for, when the printing medium is in a state of not being held by said second roller but being held by said first roller, performing printing to both of an area of the printing medium which extends out from a front edge of the printing medium in the transported direction and an area on the printing medium which is located inside the front edge;

a second printing step for, when the printing medium is in a state of being held by said first and second rollers, performing printing only to the area on the printing medium which is located inside the front edge; and an ejection amount control step for, when said first printing means perform printing, reducing the amount of ink ejected during one scanning operation compared to when said second printing means perform printing, wherein said ejection amount control step causes only the ejection openings which are located on the printing head nearer to said first roller than said second roller, to be used so that the amount of ink is reduced.

8. An ink jet printing method as claimed in claim 7, wherein the amount of ink ejected to the edge area is reduced by reducing the number of ink ejection openings used for one scanning operation.

9. An ink jet printing method of performing printing by repeating an operation of scanning a printing head having a plurality of ink ejection openings to a printing medium and an operation of transporting the printing medium, so as to eject ink from the printing head to the printing medium, wherein when printing is performed in an edge area including both of an area, which is at least one of a front and back areas located out of the printing medium in a direction in which the printing medium is transported, and an area on the printing medium which is located inside the edge, the number of times of scanning operation by the printing head which number is required to complete a predetermined width in the edge area is larger than the number of times of scanning operation by the printing head which number is required to complete the predetermined width in an area on the printing medium which is other than the edge area.

10. An ink jet printing method of performing printing by repeating an operation of scanning a printing head having a plurality of ink ejection openings to a printing medium and an operation of transporting the printing medium, so as to cause the printing head to execute a plurality of times of scanning operation in the same area of the printing medium, wherein a mask used to generate ejection data for each of said plurality of scanning operations, a total duty of the mask for the plurality of scanning operations being less than 100%, is used to generate ejection data for each scanning operation in an edge area including an edge, which is at least one of a front and back edges of the printing medium in a direction in which the printing medium is transported and having a predetermined width, so that an amount of ink ejected to the edge area is reduced compared to an area on the printing medium which is other than the edge area.

11. An ink jet printing method is claimed in claim 10, wherein the mask for each of the plurality of times of scanning operation is adapted to generate ejection data by having a duty decreasing from an interior to the edge of the printing medium.

12. An ink jet printing method of performing printing by repeating an operation of scanning a printing head having a plurality of ink ejection openings to a printing medium and an operation of transporting the printing medium, so as to eject ink from the printing head to the printing medium, wherein when printing is performed in an edge area including both of an area, which is at least one of a front and back areas located out of the printing medium in a direction in which the printing medium is transported and an area on the printing medium which is located inside the edge, the number of times of scanning operation by the printing head over a predetermined width along the transportation direction is reduced compared to printing in an area on the printing medium which is other than the edge area.

13. An ink jet printing method as claimed in claim 12, wherein printing is performed by causing the printing head to execute a plurality of times of scanning operation for the same area of the printing medium, and a mask used for generating ejection data for each of the plurality of times of scanning operation for the edge area is different from the mask used in a case of printing for an area on the printing medium which is other than the edge area.

14. An ink jet printing method of performing printing by repeating an operation of scanning a printing head having a plurality of ink ejection openings to a printing medium and an operation of transporting the printing medium, so as to cause the printing head to execute a plurality of times of scanning operation in the same area of the printing medium, wherein when printing is performed in an edge area including both of an area, which is at least one of a front and back areas located out of the printing medium in a direction in which the printing medium is transported and an area on the printing medium which is located inside the edge, a mask used for generating ejection data for each of the plurality of times of scanning operation for the edge area is different from the mask used in a case of printing for an area on the printing medium which is other than the edge area.

15. An ink jet printing method as claimed in claim 14, wherein the mask used for the edge area has a minimum mask unit greater than that of the mask used for the area other than the edge area.

16. An ink jet printing apparatus for performing printing by repeating an operation of scanning a printing head having a plurality of ink ejection openings to a printing medium and an operation of transporting the printing medium, so as to eject ink from the printing head to the printing medium, wherein when printing is performed for both areas of a first area of the printing medium, said apparatus comprising:

a first roller located upstream of the printing head in a direction in which the printing medium is transported, so as to hold and transport the printing medium;

a second roller located downstream of the printing head in the transported direction of the printing medium, so as to hold and transport the printing medium;

first printing means for, when the printing medium is in a state of not being held by said second roller but being held by said first roller, performing printing to both of a first area of the printing medium which extends out from a front edge of the printing medium in the transported direction and a second area on the printing medium which is located inside the front edge;

second printing means for, when the printing medium is in a state of being held by said first and second rollers, performing printing only to the second area on the printing medium; and third printing means for, when the printing medium is in a state of not being held by said second roller but being held by said first roller, performing printing only to the second area on the printing medium;

wherein, when said first printing means performs printing, the number of ejection openings used for one scanning operation is reduced compared to when said second printing means performs printing, and wherein said third printing means performs printing, the number of the ejection openings used for one scanning operation is reduced compared to when said second printing means performs printing.

17. An ink jet printing apparatus for performing printing by repeating an operation of scanning a printing head having a plurality of ink ejection openings to a printing medium and an operation of transporting the printing medium, so as to eject ink from the printing head to the printing medium, said apparatus comprising:

a first roller located upstream of the printing head in a direction in which the printing medium is transported, so as to hold and transport the printing medium;

a second roller located downstream of the printing head in the transported direction of the printing medium, so as to hold and transport the printing medium;

first printing means for, when the printing medium is in a state of not being held by said second roller but being held by said first roller, performing printing to both of an area of the printing medium which extends out from a front edge of the printing medium in the transported direction and an area on the printing medium which is located inside the front edge;

second printing means for, when the printing medium is in a state of being held by said first and second rollers, performing printing only to the area on the printing medium which is located inside the front edge; and ejection opening control means for, when said first printing means performs printing, reducing the number of the ejection openings used for one scanning operation compared to when said second printing means performs printing, wherein said ejection opening control means causes only the ejection openings which are located on the printing head nearer to said first roller than said second roller, to be used so that the number of the ejection openings is reduced.

18. An ink jet printing apparatus for performing printing by repeating an operation of scanning a printing head having a plurality of ink ejection openings to a printing medium and an operation of transporting the printing medium, so as to eject ink from the printing head to the printing medium, said apparatus comprising:

a first roller located upstream of the printing head in a direction in which the printing medium is transported, so as to hold and transport the printing medium;

a second roller located downstream of the printing head in the transported direction of the printing medium, so as to hold and transport the printing medium;

first printing means for, when the printing medium is in a state of not being held by said second roller but being held by said first roller, performing printing to both of an area of the printing medium which extends out from a front edge of the printing medium in the transported direction and an area on the printing medium which is located inside the front edge;

second printing means for, when the printing medium is in a state of being held by said first and second rollers, performing printing only to the area on the printing medium which is located inside the front edge; and ejection amount control means for, when said first printing means perform printing, reducing the amount of ink ejected during one scanning operation compared to when said second printing means perform printing, wherein said ejection amount control means causes only the ejection openings which are located on the printing head nearer to said first roller than said second roller, to be used so that the amount of ink is reduced.

19. An ink jet printing apparatus for performing printing by repeating an operation of scanning a printing head having a plurality of ink ejection openings to a printing medium and an operation of transporting the printing medium, so to cause the printing head to execute a plurality of times of scanning operation in the same area of the printing medium, wherein a mask used to generate ejection data for each of said plurality of scanning operations, a total duty of the mask for the plurality of scanning operations being less than 100%, is used to generate ejection data for each scanning operation in an edge area including an edge, which is at least one of a front and back edges of the printing medium in a direction in which the printing medium is transported and having a predetermined width, so that an amount of ink ejected to the edge area is reduced compared to an area on the printing medium which is other than the edge area.

20. An ink jet printing apparatus for performing printing by repeating an operation of scanning a printing head having a plurality of ink ejection openings to a printing medium and an operation of transporting the printing medium, so as to eject ink from the printing head to the printing medium, wherein when printing is performed in an edge area including both of an area, which is at least one of a front and back areas located out of the printing medium in a direction in which the printing medium is transported and an area on the printing medium which is located inside the edge, the number of times of scanning operation by the printing head over a predetermined width along the transportation direction is reduced compared to printing in an area on the printing medium which is other than the edge area.

21. An ink jet printing apparatus for performing printing by repeating an operation of scanning a printing head having a plurality of ink ejection openings to a printing medium and an operation of transporting the printing medium, so to cause the printing head to execute a plurality of times of scanning operation in the same area of the printing medium, wherein when printing is performed in an edge area including both of an area, which is at least one of a front and back areas located out of the printing medium in a direction in which the printing medium is transported and an area on the printing medium which is located inside the edge, a mask used for generating ejection data for each of the plurality of times of scanning operation for the edge area is different from the mask used in a case of printing for an area on the printing medium which is other than the edge area.

22. A program for controlling an ink jet printing apparatus for performing printing by repeating an operation of scanning a printing head having a plurality of ink ejection openings to a printing medium and an operation of transporting the printing medium, so as to eject ink from the printing head to the printing medium, said program causing a computer to execute processing comprising:

a providing step for providing a first roller located upstream of the printing head in a direction in which the printing medium is transported, so as to hold and transport the printing medium, and a second roller located downstream of the printing head in the transported direction of the printing medium, so as to hold and transport the printing medium;

a first printing step for, when the printing medium is in a state of not being held by said second roller but being held by said first roller, performing printing to both of a first area of the printing medium which extends out from a front edge of the printing medium in the transported direction and a second area on the printing medium which is located inside the front edge;

a second printing step for, when the printing medium is in a state of being held by said first and second rollers, performing printing only to the second area on the printing medium; and a third printing step for, when the printing medium is in a state of not being held by said second roller but being held by said first roller, performing printing only to the second area on the printing medium, wherein, when said first printing step performs printing, the number of ejection openings used for one scanning operation is reduced compared to when said second printing step performs printing, and wherein, when said third printing step performs printing, the number of the ejection openings used for one scanning operation is reduced compared to when said second printing step performs printing.

23. A program for controlling an ink jet printing apparatus for performing printing by repeating an operation of scanning a printing head having a plurality of ink ejection openings to a printing medium and an operation of transporting the printing medium, so as to eject ink from the printing head to the printing medium, said program causing a computer to execute processing comprising a providing step for providing a first roller located upstream of the printing head in a direction in which the printing medium is transported, so as to hold and transport the printing medium, and a second roller located downstream of the printing head in the transported direction of the printing medium, so as to hold and transport the printing medium;

a first printing step for, when the printing medium is in a state of not being held by said second roller but held by said first roller, performing printing to both of an area of the printing medium which extends out from a front edge of the printing medium in the transported direction and an area on the printing medium which is located inside the front edge;

a second printing step for, when the printing medium is in a state of being held by said first and second rollers, performing printing only to the area on the printing medium which is located inside the front edge; and an ejection opening control step for, when said first printing step performs printing, reducing the number of the ejection openings used for one scanning operation compared to when said second printing step performs printing, wherein said ejection opening control step causes only the ejection openings which are located on the printing head nearer to said first roller than said second roller, to be used so that the number of the ejection openings is reduced.

24. A program for controlling an ink jet printing apparatus for performing printing by repeating an operation of scanning a printing head having a plurality of ink ejection openings to a printing medium and an operation of transporting the printing medium, so as to eject ink from the printing head to the printing medium, said program causing a computer to execute processing comprising:

a providing step for providing a first roller located upstream of the printing head in a direction in which the printing medium is transported, so as to hold and transport the printing medium, and a second roller located downstream of the printing head in the transported direction of the printing medium, so as to hold and transport the printing medium;

a first printing step for, when the printing medium is in a state of not being held by said second roller but held by said first roller, performing printing to both of an area of the printing medium which extends out from a front edge of the printing medium in the transported direction and an area on the printing medium which is located inside the front edge;

a second printing step for, when the printing medium is in a state of being held by said first and second rollers, performing printing only to the area on the printing medium which is located inside the front edge; and an ejection amount control step for, when said first printing step performs printing, reducing the amount of ink ejected during one scanning operation compared to when said second printing step performs printing, wherein said ejection amount control step causes only the ejection openings which are located on the printing head nearer to said first roller than said second roller, to be used so that the amount of ink is reduced.

25. A storage medium, from which computer can read data, storing a program as claimed in any of claims 21 to 24.

26. A program for controlling an ink jet printing apparatus for performing printing by repeating an operation of scanning a printing head having a plurality of ink ejection openings to a printing medium and an operation of transporting the printing medium, so as to cause the printing head to execute a plurality of times of scanning operation in the same area of the printing medium, wherein said program causes a computer to execute processing that when printing is performed in an edge area including both of an area, which is at least one of a front and back areas located out of the printing medium in a direction in which the printing medium is transported and an area on the printing medium which is located inside the edge, a mask used for generating ejection data for each of the plurality of times of scanning operation for the edge area is different from the mask used in a case of printing for an area on the printing medium which is other than the edge area.

* * * * *

UNITED STATES PATENT AND TRADEMARK OFFICE

CERTIFICATE OF CORRECTION

PATENT NO. : 6,866,358 B2
APPLICATION NO. : 10/214109
DATED : March 15, 2005
INVENTOR(S) : Atsuhiko Masuyama et al.

It is certified that error appears in the above-identified patent and that said Letters Patent is hereby corrected as shown below:

Title page,
Item [30], Foreign Application Priority Data,
"2001/245030" should read -- 2001-245030 -- and
"2002/225314" should read -- 2002-225314 --.
Item [56], References Cited, FOREIGN PATENT DOCUMENTS,
"EP 0995603 A2 * 4/2000……..B41J/2/185" should be deleted.

Drawings,
Sheet 11, FIG. 9B, "(DRA CONTROL)" should read -- (DRAM CONTROL) --.

Column 1,
Line 34, "photographs" should read -- photographs. --.

Column 7,
Line 28, "rotatable" should read -- rotatably --.

Column 8,
Line 9, "H10000" should read -- H1000--.

Column 9,
Line 30, "contract" should read -- contact --.

Column 14,
Line 19, "E10001." should read -- E1001. --.

Column 15,
Line 42, "step S7 These" should read -- step S7. This --.

Column 18,
Line 57, "In" should read -- in --.

Column 19,
Line 41, "edge," should read -- edge, and --.

UNITED STATES PATENT AND TRADEMARK OFFICE

CERTIFICATE OF CORRECTION

PATENT NO. : 6,866,358 B2
APPLICATION NO. : 10/214109
DATED : March 15, 2005
INVENTOR(S) : Atsuhiko Masuyama et al.

It is certified that error appears in the above-identified patent and that said Letters Patent is hereby corrected as shown below:

Column 20,
Line 56, “medium” should read -- medium. --.

Column 21,
Line 21, “masts” should read -- masks --.
Line 44, “operations” should read -- operations. --.

Column 22,
Line 18, “areas” should read -- area, --.
Line 24, “$+^1/_{16}$” should read -- $+^1/_6$ --.

Column 24,
Line 22, “embodiments” should read -- embodiment --.

Column 26,
Line 59, “perform” should read -- performs --.

Column 27,
Line 35, “is” should read -- as --.

Column 29,
Line 45, “perform” should read -- performs --.

Column 31,
Line 5, “comprising” should read -- comprising: --.

UNITED STATES PATENT AND TRADEMARK OFFICE

CERTIFICATE OF CORRECTION

PATENT NO. : 6,866,358 B2
APPLICATION NO. : 10/214109
DATED : March 15, 2005
INVENTOR(S) : Atsuhiko Masuyama et al.

It is certified that error appears in the above-identified patent and that said Letters Patent is hereby corrected as shown below:

Column 32,
Line 25, "claims 21 to 24." should read -- claims 22 to 24. --.

Signed and Sealed this

Twenty-fifth Day of July, 2006

JON W. DUDAS
*Director of the United States Patent and Trademark Office*